US009904233B2

(12) United States Patent
Shimizu et al.

(10) Patent No.: US 9,904,233 B2
(45) Date of Patent: Feb. 27, 2018

(54) BLADE, CLEANING DEVICE, AND IMAGE FORMING APPARATUS INCORPORATING SAME

(71) Applicants: Eisuke Shimizu, Tokyo (JP); Kazuhiko Watanabe, Tokyo (JP); Takaaki Tawada, Kanagawa (JP); Yuu Sakakibara, Hokkaido (JP)

(72) Inventors: Eisuke Shimizu, Tokyo (JP); Kazuhiko Watanabe, Tokyo (JP); Takaaki Tawada, Kanagawa (JP); Yuu Sakakibara, Hokkaido (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 15/339,269

(22) Filed: Oct. 31, 2016

(65) Prior Publication Data

US 2017/0146944 A1 May 25, 2017

(30) Foreign Application Priority Data

Nov. 24, 2015 (JP) ..... 2015-228758

(51) Int. Cl.
*G03G 21/00* (2006.01)

(52) U.S. Cl.
CPC . *G03G 21/0017* (2013.01); *G03G 2221/0089* (2013.01)

(58) Field of Classification Search
CPC ..... G03G 21/0011; G03G 21/0017; G03G 2221/0089

(Continued)

(56) References Cited

U.S. PATENT DOCUMENTS

2008/0286020 A1 11/2008 Watanabe et al.
2009/0123205 A1 5/2009 Watanabe et al.

(Continued)

FOREIGN PATENT DOCUMENTS

JP 2013-076970 4/2013
JP 2014-240946 12/2014

OTHER PUBLICATIONS

U.S. Appl. No. 15/219,782, filed Jul. 26, 2016.

*Primary Examiner* — Benjamin Schmitt
(74) *Attorney, Agent, or Firm* — Oblon, McClelland, Maier & Neustadt, L.L.P.

(57) ABSTRACT

An elastic blade includes a contact edge to contact a contact object, an edge region including the contact edge, and a backup region different in at least one of material and physical property from the edge region and adjacent to the edge region on a cross section perpendicular to a direction in which the contact edge extends. The backup region is free of direct contact with the contact object. In the elastic blade, a converted elastic power X is from 57% to 90% and defined as $$X = \frac{S_A}{S_A + S_B} \times e_A + \frac{S_B}{S_A + S_B} \times e_B$$

where $S_A$ and $S_B$ represent cross-sectional areas of the edge region and the backup region on the cross section, and $e_A$ and $e_B$ represent elastic powers of the edge region and the backup region.

11 Claims, 5 Drawing Sheets

(58) Field of Classification Search
USPC ..... 399/123, 343, 350, 351
See application file for complete search history.

(56) References Cited

U.S. PATENT DOCUMENTS

| | | | | |
|---|---|---|---|---|
| 2010/0067945 | A1 | 3/2010 | Hozumi et al. | |
| 2010/0067949 | A1 | 3/2010 | Watanabe et al. | |
| 2011/0229186 | A1 | 9/2011 | Okamoto et al. | |
| 2011/0229188 | A1 | 9/2011 | Watanabe et al. | |
| 2011/0229233 | A1 | 9/2011 | Watanabe et al. | |
| 2012/0207507 | A1 | 8/2012 | Okamoto et al. | |
| 2013/0071163 | A1 | 3/2013 | Watanabe et al. | |
| 2014/0119769 | A1 | 5/2014 | Kikuchi et al. | |
| 2014/0161501 | A1 | 6/2014 | Watanabe et al. | |
| 2014/0193172 | A1 | 7/2014 | Tawada et al. | |
| 2014/0205338 | A1* | 7/2014 | Gondoh ..... | G03G 21/0017 399/350 |
| 2014/0233998 | A1 | 8/2014 | Watanabe et al. | |
| 2014/0341629 | A1 | 11/2014 | Watanabe et al. | |
| 2015/0355566 | A1 | 12/2015 | Kikuchi et al. | |
| 2015/0370217 | A1 | 12/2015 | Shimizu et al. | |
| 2016/0097987 | A1 | 4/2016 | Kikuchi et al. | |
| 2016/0109846 | A1 | 4/2016 | Shimizu et al. | |
| 2016/0259293 | A1 | 9/2016 | Shimizu et al. | |

* cited by examiner

PERIPHERAL LENGTH: C1
PROJECTED AREA: S

AREA: S
PERIPHERAL LENGTH: C2

BLADE, CLEANING DEVICE, AND IMAGE FORMING APPARATUS INCORPORATING SAME

CROSS-REFERENCE TO RELATED APPLICATIONS

This patent application is based on and claims priority pursuant to 35 U.S.C. § 119(a) to Japanese Patent Application No. 2015-228758, filed on Nov. 24, 2015, in the Japan Patent Office, the entire disclosure of which is hereby incorporated by reference herein.

BACKGROUND

Technical Field

Embodiments of the present invention generally relate to a blade, a cleaning device including the blade, and an image forming apparatus, such as a copier, a printer, a facsimile machine, or a multifunction peripheral having at least two of copying, printing, facsimile transmission, plotting, and scanning capabilities, that includes at least one of the blade and the cleaning device.

Description of the Related Art

In electrophotographic image forming apparatuses, after a toner image is transferred from a surface of a photoconductor serving as an image bearer onto a recording sheet or an intermediate transfer member (e.g., an intermediate transfer belt or an intermediate transfer drum), a cleaning device removes toner remaining (i.e., residual toner) on the surface of the image bearer.

Cleaning devices employing an elastic blade, such as a cleaning blade, are widely used for a simple structure and high cleaning capability thereof.

In such a configuration, an edge (i.e., a ridgeline or corner at an end) of the blade is disposed in contact with (abutting against) the surface of the image bearer (i.e., a contact object) to clean the image bearer.

SUMMARY

An embodiment of the present invention provides an elastic blade that includes a contact edge to contact a contact object, an edge region including the contact edge, and a backup region different in at least one of a material and a physical property from the edge region. The backup region is adjacent to the edge region on a cross section perpendicular to a direction in which the contact edge extends. The backup region is free of direct contact with the contact object. In the elastic blade, a converted elastic power X is in a range of from 57% to 90% and defined as $$X = \frac{S_A}{S_A + S_B} \times e_A + \frac{S_B}{S_A + S_B} \times e_B$$

where $S_A$ represents a cross-sectional area in millimeters of the edge region on the cross section, $S_B$ represents a cross-sectional area in millimeters of the backup region on the cross section, $e_A$ represents an elastic power of the edge region, and $e_B$ represents an elastic power of the backup region. On the cross section, the edge region has a long side to oppose the contact object, and a short side to oppose the contact object, and the edge region thickness represents a thickness of the edge region in a direction perpendicular to the long side of the edge region.

In another embodiment, an image forming apparatus includes an image bearer, and the elastic blade described above. The contact edge of the elastic blade is disposed in contact with a surface of the image bearer to clean the image bearer.

In yet another embodiment, a cleaning device includes the above-described elastic blade, a blade holder to support the elastic blade, and a pressing device to press, via the blade holder, the contact edge of the elastic blade against the contact object.

BRIEF DESCRIPTION OF THE SEVERAL VIEWS OF THE DRAWINGS

A more complete appreciation of the disclosure and many of the attendant advantages thereof will be readily obtained as the same becomes better understood by reference to the following detailed description when considered in connection with the accompanying drawings, wherein.

Figure 1:
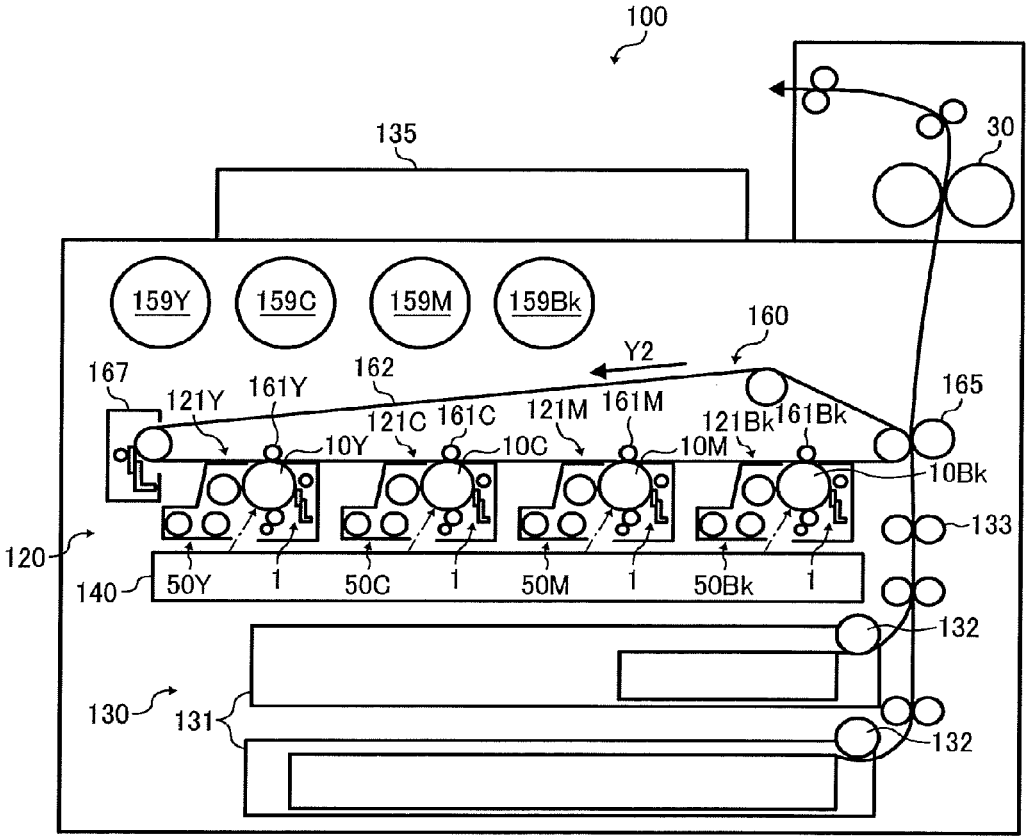
FIG. 1 is a schematic view of an image forming apparatus according to an embodiment.

The accompanying drawings are intended to depict embodiments of the present invention and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

Referring now to the drawings, wherein like reference numerals designate identical or corresponding parts throughout the several views thereof, and particularly to FIG. 1, descriptions are given below of an electrophotographic printer as an example of an image forming apparatus including a blade according to an embodiment. In the description below, the blade is a cleaning blade included in a cleaning device to clean an image bearer, and the image forming apparatus is a printer, for example.

FIG. 1 is a schematic diagram of an image forming apparatus 100 according to the present embodiment.

The image forming apparatus 100 is capable of forming multicolor images and includes an image forming unit 120, an intermediate transfer unit 160, and a sheet feeder 130. It is to be noted that subscripts Y, C, M, and Bk represent that components given subscripts Y, C, M, and Bk relate to formation of yellow, magenta, cyan, and black images, respectively.

The image forming unit 120 includes process cartridges 121Y, 121C, 121M, and 121Bk for yellow, cyan, magenta, and black, respectively. The process cartridges 121 (121Y, 121C, 121M, and 121Bk) are arranged in line in a substantially horizontal direction. The process cartridges 121 are removably insertable into the image forming apparatus 100.

The intermediate transfer unit 160 includes an intermediate transfer belt 162, which is an endless belt, primary transfer rollers 161 (161Y, 161C, 161M, and 161Bk), and a secondary transfer roller 165. The intermediate transfer belt 162 is entrained around multiple support rollers.

The intermediate transfer belt 162 is positioned above the process cartridges 121 and along the direction in which drum-shaped photoconductors 10Y, 10C, 10M, and 10Bk (i.e., latent image bearers) of the process cartridges 121Y, 121C, 121M, and 121Bk rotate.

The intermediate transfer belt 162 rotates in synchronization with the rotation of the photoconductors 10.

The primary transfer rollers 161 are positioned along the inner side of the loop of the intermediate transfer belt 162. The primary transfer rollers 161 lightly press the outer face of the intermediate transfer belt 162 against the surfaces of the photoconductors 10.

The process cartridges 121 are similar in configuration and operation to form toner images on the respective photoconductors 10 and transfer the toner images onto the intermediate transfer belt 162.

However, the three primary transfer rollers 161Y, 161C, and 161M corresponding to the process cartridges 121Y, 121C, and 121 M for colors other than black are movable vertically with a pivot mechanism. The pivot mechanism disengages the intermediate transfer belt 162 from the photoconductors 10Y, 10C, and 10M when multicolor image formation is not performed.

Additionally, a belt cleaning device 167 is disposed downstream from the secondary transfer roller 165 and upstream from the process cartridge 121Y in the direction indicated by arrow Y2 illustrated in FIG. 1, in which the intermediate transfer belt 162 rotates.

Above the intermediate transfer unit 160, toner cartridges 159 for the respective process cartridges 121 are disposed side by side in a horizontal or almost horizontal direction. Below the process cartridges 121, an exposure device 140 is disposed to irradiate, with laser beams, the charged surfaces of the photoconductors 10 to form electrostatic latent images thereon.

The sheet feeder 130 is disposed below the exposure device 140. The sheet feeder 130 includes sheet trays 131 for containing sheets of recording media (i.e., recording sheets) and sheet feeding rollers 132. The sheet feeder 130 feeds recording sheets to a secondary transfer nip formed between the intermediate transfer belt 162 and the secondary transfer roller 165 via a registration roller pair 133 at a predetermined timing.

A fixing device 30 is disposed downstream from the secondary transfer nip in the direction in which recording sheets are transported (hereinafter "sheet conveyance direction"). Further, an ejection roller and an output tray 135 to receive recording sheets discharged are disposed downstream from the fixing device 30 in the sheet conveyance direction.

Figure 2:
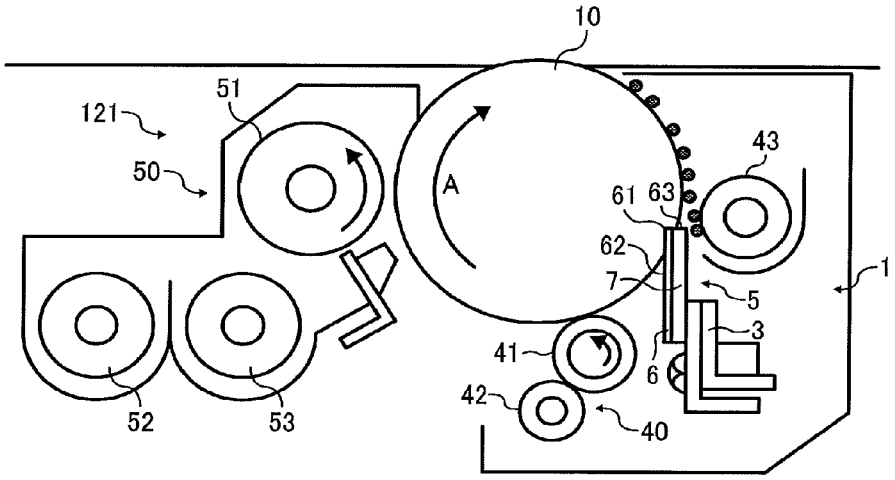
FIG. 2 is a schematic cross-sectional view illustrating a process cartridge installable in the image forming apparatus illustrated in FIG. 1.

Referring to FIG. 2, a configuration of the process cartridges 121 (121Y, 121C, 121M, 121Bk) is described below.

FIG. 2 schematically illustrates a configuration of the process cartridge 121 of the image forming apparatus 100. In the present embodiment, the cleaning blade 5 can have one of four structures (hereinafter "Blade types 1 through 4) illustrated in FIGS. 4A through 4D. In FIG. 2, the cleaning blade 5 of Blade type 2 illustrated in FIG. 4B is illustrated.

The process cartridges 121 have a similar configuration, and therefore the subscripts Y, C, M, and Bk for color discrimination are omitted when the configuration and operation of the process cartridges 121 are described.

In addition to the drum-shaped photoconductor 10, the process cartridge 121 includes a cleaning device 1, a charging device 40, and a developing device 50 (50Y, 50C, 50M, or 50Bk in FIG. 1) disposed around the photoconductor 10 as illustrated in FIG. 2.

The cleaning device 1 includes the cleaning blade 5, which is a strip-shaped elastic member and long in the axial direction of the photoconductor 10. The cleaning device 1 presses an edge 61 (ridgeline at an end) of the cleaning blade 5 to the surface of the photoconductor 10. The edge 61 extends in a direction perpendicular to the rotation direction of the photoconductor 10. With the edge 61, the cleaning device 1 removes substances, such as residual toner, from the surface of the photoconductor 10. A discharge screw 43 of the cleaning device 1 discharges the removed toner outside cleaning device 1.

The charging device 40 includes a charging roller 41 opposing the photoconductor 10 and a roller cleaner 42 that rotates while being in contact with the charging roller 41.

The developing device 50 is designed to supply toner to the surface of the photoconductor 10 to develop the latent image formed thereon into a visible image and includes a developing roller 51 serving as a developer bearer to bear developer including carrier and toner. The developing device 50 includes the developing roller 51, an agitation screw 52, and a supply screw 53. The agitation screw 52 stirs and transports developer contained in the developing device 50 (in particular, a developer container therein), and the supply screw 53 transports the developer while supplying the agitated developer to the developing roller 51.

The four process cartridges 121 having the above-described configuration can be independently removed from a printer body, installed therein, and replaced by service persons or users. When the process cartridge 121 is removed from the image forming apparatus 100, the photoconductor 10, the charging device 40, the developing device 50, and the cleaning device 1 can be replaced independently. It is to be noted that the process cartridge 121 can further include a waste-toner tank to collect the toner removed by the cleaning device 1. In this case, it is convenient when the waste-toner tank is independently removable, installable, and replaceable.

Next, image forming operation is described below.

The image forming apparatus 100 receives print commands via a control panel or from external devices such as computers. Initially, the photoconductor 10 starts rotating in the direction indicated by arrow A illustrated in FIG. 2, and the charging rollers 41 charge the surfaces of the photoconductors 10 uniformly in a predetermined polarity. The exposure device 140 directs light, such as laser beams, for respective colors to the charged photoconductors 10. The laser beams are optically modulated according to multicolor image data input to the image forming apparatus 100. Thus, electrostatic latent images for respective colors are formed on the photoconductors 10.

The developing rollers 51 of the developing devices 50 supply respective color toners to the electrostatic latent images, thereby developing the electrostatic latent images into toner images (visible images).

Subsequently, the transfer voltage opposite in polarity to the toner image is given to the primary transfer roller 161, thereby generating a primary transfer electrical field between the photoconductor 10 and the primary transfer roller 161 via the intermediate transfer belt 162. Simultaneously, the primary transfer roller 161 lightly nips (presses against) the intermediate transfer belt 162 to form the primary transfer nip. With the transfer electrical field and the nip pressure, the toner images on the respective photoconductors 10 are transferred onto the intermediate transfer belt 162 efficiently (i.e., primary image-transfer). The respective single-color toner images formed on the photoconductors 10 are superimposed one on another on the intermediate transfer belt 162, forming a multilayer toner image (i.e., multicolor toner image).

Toward the multilayer toner image on the intermediate transfer belt 162, a recording sheet is timely transported from the sheet tray 131 via the sheet feeding roller 132 and the registration roller pair 133. The secondary transfer roller 165 is given a transfer voltage opposite in polarity to toner images, and a secondary-transfer electrical field is generated between the intermediate transfer belt 162 and the secondary transfer roller 165 via the recording sheet. The toner image is transferred onto the recording sheet by the secondary-transfer electrical field (i.e., secondary image-transfer). The recording sheet is then transported to the fixing device 30, in which the toner image is fixed on the recording sheet with heat and pressure. The recording sheet bearing the fixed toner image is discharged by the ejection roller to the output tray 135. Meanwhile, the cleaning blades 5 of the cleaning devices 1 removes the toner remaining on the respective photoconductors 10 after the primary image-transfer.

Next, descriptions are given below of the cleaning device 1 of the image forming apparatus 100 according to the present embodiment and features of the cleaning blade 5 usable in the cleaning device 1, using multiple examples.

Embodiment 1

The cleaning blade 5 according to Embodiment 1, usable in the above-described cleaning device 1, is described with reference to the drawings.

Figure 3:
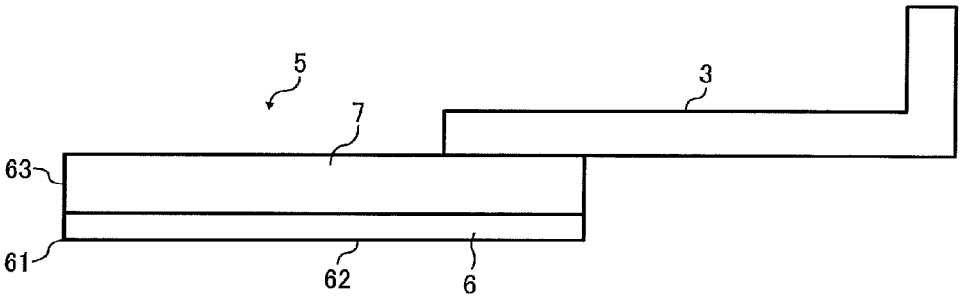
FIG. 3 is a schematic cross-sectional view of a basic structure of a cleaning blade according to Embodiments 1 through 10.

FIG. 3 is a schematic cross-sectional view of the cleaning blade 5. Similar to FIG. 2, the cleaning blade 5 illustrated in FIG. 3 is Blade type 2 illustrated in FIG. 4B, of the four types illustrated in FIGS. 4A through 4D.

Referring to FIG. 3, a basic structure of the cleaning blade 5, made of an elastic material, is described.

As illustrated in FIG. 3, the cleaning blade 5 includes an opposing face 62 including the edge 61 and opposing the photoconductor 10 (contact object), and an end face 63 including the edge 61 and adjacent to the opposing face 62.

Further, on a cross section perpendicular to the direction in which the edge 61 extends, the cleaning blade 5 includes an edge region 6 and a backup region 7 different in at least one of material and physical property from the edge region 6. The edge region 6 includes the edge 61. The backup region 7 does not include the edge 61 and is free of direct contact with the photoconductor 10.

In other words, the cleaning blade 5 is a so-called two-region blade including the edge region 6 and the backup region 7 different in at least one of material and physical property from the edge region 6, on the cross section perpendicular to the direction in which the edge 61 extends.

There are elastic blades in which the hardness in increased in a portion around the edge.

When an edge portion of the blade is relatively hard, the blade can better scrape off substances adhering to the surface of the image bearer (e.g., a photoconductor) serving as the contact object, thereby inhibiting filing (solidification of substances on the surface of the image bearer) that causes image failure.

However, when the edge portion is relatively hard and the blade as a whole has a low elasticity, there may arise inconveniences. For example, the blade tends to fatigue, or the capability (i.e., follow-up capability) of the blade to follow the shape of the contact object tends to decrease. By contrast, when the elasticity of the entire blade is high, there arises a risk of chipping of the edge of the blade due to vibration of the blade or stick-slip of the blade, meaning that the blade repeatedly sticks to and slips on the contact object.

Such inconveniences degrade the cleaning capability of the blade to remove the substances adhering or firmly sticking to the contact object.

In view of the foregoing, the inventors have studied configurations capable of inhibiting degradation of the follow-up capability and fatigue of the blade, while inhibiting chipping of the edge in blades.

The inventors have devised the cleaning blade 5 that is made of an elastic material such as urethane rubber and includes the edge 61 (a ridgeline) to contact the surface of the photoconductor 10. In particular, on a cross section perpendicular to the direction in which the edge 61 extends (hereinafter "edge extending direction"), the cleaning blade 5 includes the edge region 6 including the edge 61 and the backup region 7 different in at least one of material and physical property from the edge region 6. The backup region 7 does not include the edge 61 and does not contact the photoconductor 10.

In addition, in the cleaning blade 5, a converted elastic power X defined by Formula 1 is greater than or equal to 57% and smaller than or equal to 90% (in a range of from 57% to 90%), $$X = \frac{S_A}{S_A + S_B} \times e_A + \frac{S_B}{S_A + S_B} \times e_B \qquad \text{Formula 1}$$

where $S_A$ represents a cross-sectional area (in millimeters) of the edge region 6 on the cross section perpendicular to the edge extending direction, $S_B$ represents a cross-sectional area (in millimeters) of the backup region 7 on the cross section perpendicular to the edge extending direction, $e_A$ represents an elastic power (%) of the edge region 6, and $e_B$ represents an elastic power (%) of the backup region 7.

The edge region thickness t means a thickness of the edge region 6 in a direction perpendicular to the longer of two sides of the edge region 6 opposing the photoconductor 10 (see FIG. 2) on the cross section perpendicular to the edge extending direction (see FIGS. 4A through 4D).

The converted elastic power X, defined by Formula 1, is used to evaluate the elasticity of the entire cleaning blade 5.

When the converted elastic power X is in the range of from 57% to 90%, the degradation of the follow-up capability and the fatigue of the cleaning blade 5, which occur when the entire cleaning blade 5 has a relatively low elasticity, are suppressed. Simultaneously, the risk of vibration of the cleaning blade 5 and chipping of the edge 61 of the cleaning blade 5 due to stick-slip, which occur when the cleaning blade 5 has a relatively high elasticity, are suppressed.

Accordingly, while inhibiting the degradation of the capability of the cleaning blade 5 to follow the photoconductor 10 and fatigue of the cleaning blade 5, chipping of the edge 61 due to the vibration of the cleaning blade 5 or stick-slip of the edge 61 can be suppressed.

Figure 4A:
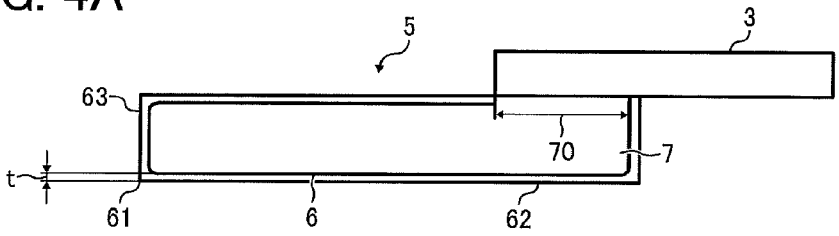
FIGS. 4A through 4D are schematic views of cleaning blade types according to Embodiments 1 through 10.
Figure 4B:
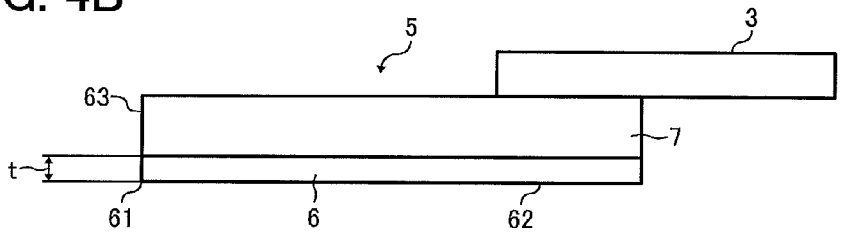

FIGS. 4A though 4D illustrate example blade structures on the cross section perpendicular to the extending direction of the edge 61, applicable to the cleaning blade 5.

In Blade type 1, as illustrated in FIG. 4A, the edge region 6 extends along the circumference of the cleaning blade 5 (surrounds the backup region 7) except a connected area 70 adjoining a blade holder 3. In a portion around the edge 61 (a corner portion), the boundary between the edge region 6 and the backup region 7 is arc-shaped, and the corner of the backup region 7 is chamfered.

In Blade type 1, as illustrated in FIG. 4A, the edge region thickness t is a thickness of a long side of the edge region 6 on the cross section perpendicular to the edge extending direction. In particular, the edge region thickness t represents the thickness of the edge region 6 at the corner as a length in the direction perpendicular to the opposing face 62.

In Blade type 2, as illustrated in FIG. 4B, the cleaning blade 5 is divided into the edge region 6 and the backup region 7 with a boundary parallel to the long side of the cleaning blade 5. Blade type 2 is a double-layered blade, which is one type of two-region blades.

In Blade type 2, as illustrated in FIG. 4B, the edge region thickness t is the thickness of the edge region 6 on the cross section perpendicular to the edge extending direction. In particular, the edge region thickness t represents a length of the edge region 6 in the direction perpendicular to the opposing face 62, which is the long side to oppose the photoconductor 10.

Figure 4C:
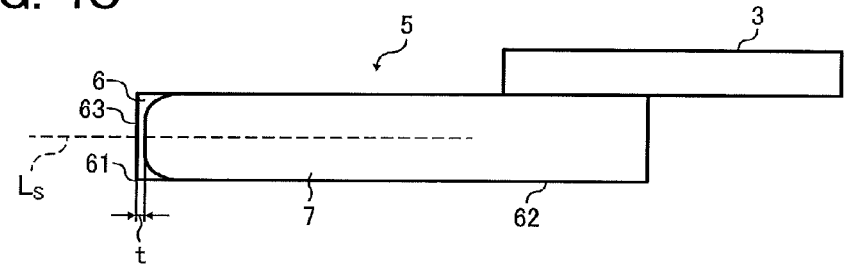

In Blade type 3, as illustrated in FIG. 4C, the boundary between the edge region 6 and the backup region 7 is symmetrical relative to a reference line $L_s$ perpendicular a center of the end face 63. The boundary is curved in end portions (around the corners of the cleaning blade 5) away from the reference line $L_s$. In other words, the edge region 6 includes curved portions in which the thickness of the edge region 6 (length parallel to the long side of the cleaning blade 5) increases toward the corner of the cleaning blade 5. In a portion closer to the reference line $L_s$ than the curved portions, the edge region 6 is almost linear and the thickness in the direction parallel to the long side is constant or almost constant.

In Blade type 3, as illustrated in FIG. 4C, the edge region thickness t is the thickness of the linear portion of the edge region 6 on the cross section perpendicular to the edge extending direction. The edge region thickness t represents the length parallel to the opposing face 62.

Figure 4D:
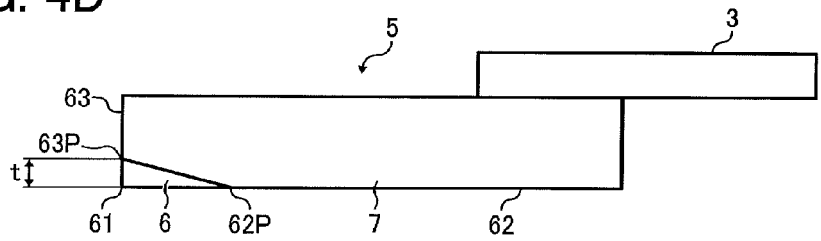

In Blade type 4 illustrated in FIG. 4D, the boundary between the edge region 6 and the backup region 7 is a segment that linearly connects a point 62P on the opposing face 62 and a point 63P on the end face 63. The points 62P and 63P define two segments starting from the edge 61, respectively. The edge region 6 divided with the segment from the backup region 7 is a triangle (e.g., a right triangle in FIG. 4D).

In Blade type 4, as illustrated in FIG. 4D, the edge region thickness t is a thickness in the direction perpendicular to the longer of the two sides of the edge region 6 on the cross section perpendicular to the edge extending direction. In FIG. 4D, the edge region thickness t is a length of a portion of the end face 63, which defines the periphery of the edge region 6 and perpendicular to the opposing face 62.

Before describing a verification experiment of the cleaning blade 5 according to the present embodiment, descriptions are given of measurements of Martens hardness and elastic power of the regions, using the edge region 6 (blade edge) as an example.

The Martens hardness and the elastic power of the edge region 6 mentioned above were obtained using a micro hardness measuring system, FISCHERSCOPE® HM2000, from Fischer Technology, Inc.

Push a Vickers penetrator in the cleaning blade 5 at 20 μm from the edge 61 (ridgeline at the end), with a strength of 1.0 mN for 10 seconds, keep that state for 5 seconds, and gradually draw out the Vickers penetrator in 10 seconds. Then, measure the Martens hardness.

Figure 5:
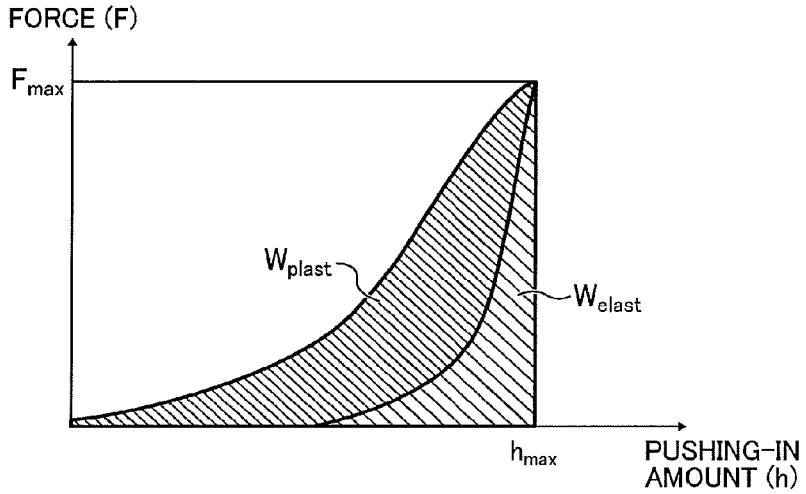
FIG. 5 is a graph of cumulative stress while a Vickers penetrator is pushed in, and cumulative stress in removal of a test load.

Concurrently with measurement of the Martens hardness, the elastic power is calculated. The elastic power is a characteristic value defined as $$W_{elast}/W_{plast}\times 100\%,$$

wherein $W_{plast}$ represents the cumulative stress while the Vickers penetrator is pushed in, and $W_{elast}$ represents cumulative stress in removal of the test load (see FIG. 5). As the elastic power increases, the percentage of plastic power during the period from application of force to distort the material to remove the load becomes smaller. That is, the percentage of plastic deformation when the rubber is deformed by force is smaller.

Next, a verification experiment performed to ascertain effects attained by examples of the cleaning blade 5 according to the present embodiment is described.

Evaluation of Cleaning Capability

The cleaning capability was evaluated under the following conditions.

As a test machine (an image forming apparatus), Ricoh MPC 3503 was used. In the test machine, the cleaning blade 5 of the process cartridge 121 illustrated in FIG. 2 was replaced with those according to Configurations 1 through 16 and Comparative examples 1 through 12 specified in Table 1.

The test machine was left unused for 24 hours in the cold environment (with a temperature of 10° C. and a humidity of 15%), and then images were successively output on 20,000 sheets. To input a greater amount of toner to the photoconductor 10, a solid image extending entirely was output on A4-size sheets.

The cleaning capability was rated in four grades of "Excellent", "Good", "Acceptable", and "Poor" in the following manner.

Excellent: After output of 20,000 sheets, the trace of defective cleaning is not observed on the recording sheets, and practically there are no problems. Defective cleaning does not occur even under a severe condition in which the charging current is increased, which is a harsh condition for cleaning.

Good: After output of 20,000 sheets, the trace of defective cleaning is not observed on the recording sheets, and practically there are no problems.

Acceptable: No trace of defective cleaning is observed on the recording sheets after output of 20,000 sheets. Although there is no practical disadvantage, toner escaping the cleaning blade 5 on the photoconductor 10 is observed with eyes.

Poor: After output of 20,000 sheets, the trace of defective cleaning is observed on the recording sheets, and the outputs images are practically substandard.

Verification Results

Table 1 below presents evaluation results of configurations according to the present embodiment and the comparative examples (represented by "CMP examples").

TABLE 1

| | Blade type | X | $S_A$ [mm$^2$] | $S_B$ [mm$^2$] | $e_A$ | $e_B$ | t [mm] | Cleaning capability |
|---|---|---|---|---|---|---|---|---|
| Configuration 1 | 1 | 90 | 1.4 | 21.1 | 80 | 91 | 0.05 | Excellent |
| Configuration 2 | 2 | 90 | 6.3 | 16.3 | 83 | 92 | 0.50 | Excellent |
| Configuration 3 | 3 | 90 | 0.2 | 22.3 | 80 | 90 | 0.09 | Excellent |
| Configuration 4 | 4 | 90 | 0.2 | 22.3 | 80 | 90 | 0.09 | Excellent |
| Configuration 5 | 1 | 77 | 5.8 | 16.8 | 70 | 80 | 0.20 | Excellent |
| Configuration 6 | 2 | 77 | 6.3 | 16.3 | 70 | 80 | 0.50 | Excellent |
| Configuration 7 | 3 | 80 | 0.2 | 22.3 | 70 | 80 | 0.10 | Excellent |
| Configuration 8 | 4 | 80 | 0.2 | 22.3 | 70 | 80 | 0.10 | Excellent |
| Configuration 9 | 1 | 75 | 5.8 | 16.8 | 60 | 80 | 0.20 | Good |
| Configuration 10 | 2 | 74 | 6.3 | 16.3 | 60 | 80 | 0.50 | Good |
| Configuration 11 | 3 | 80 | 0.2 | 22.3 | 60 | 80 | 0.10 | Good |
| Configuration 12 | 4 | 80 | 0.2 | 22.3 | 60 | 80 | 0.10 | Good |
| Configuration 13 | 1 | 57 | 5.8 | 16.8 | 50 | 60 | 0.20 | Acceptable |
| Configuration 14 | 2 | 57 | 6.3 | 16.3 | 50 | 60 | 0.50 | Acceptable |
| Configuration 15 | 3 | 57 | 0.2 | 22.3 | 50 | 57 | 0.10 | Acceptable |
| Configuration 16 | 4 | 57 | 0.2 | 22.3 | 50 | 57 | 0.10 | Acceptable |
| CMP example 1 | 1 | 56 | 5.8 | 10.5 | 50 | 60 | 0.20 | Poor |
| CMP example 2 | 2 | 56 | 11.3 | 13.8 | 50 | 60 | 0.90 | Poor |
| CMP example 3 | 3 | 56 | 0.2 | 22.3 | 50 | 56 | 0.10 | Poor |
| CMP example 4 | 4 | 56 | 0.2 | 22.3 | 50 | 56 | 0.10 | Poor |
| CMP example 5 | 1 | 47 | 5.8 | 16.8 | 40 | 50 | 0.20 | Poor |
| CMP example 6 | 2 | 47 | 6.3 | 16.3 | 40 | 50 | 0.50 | Poor |
| CMP example 7 | 3 | 50 | 0.2 | 22.3 | 40 | 50 | 0.10 | Poor |
| CMP example 8 | 4 | 50 | 0.2 | 22.3 | 40 | 50 | 0.10 | Poor |
| CMP example 9 | 1 | 91 | 2.9 | 15.9 | 90 | 91 | 0.10 | Poor |
| CMP example 10 | 2 | 91 | 6.3 | 16.3 | 90 | 91 | 0.50 | Poor |
| CMP example 11 | 3 | 91 | 0.2 | 22.3 | 90 | 91 | 0.10 | Poor |
| CMP example 12 | 4 | 91 | 0.2 | 22.3 | 90 | 91 | 0.10 | Poor |

Configuration 1

The blade type used is Blade type 1 illustrated in FIG. 4A. The edge region 6 including the edge 61 has a cross-sectional area $S_A$ of 1.4 mm$^2$, the backup region 7 has a cross-sectional area $S_B$ of 21.1 mm$^2$, the elastic power $e_A$ of the edge region 6 is 80%, and the elastic power $e_B$ of the backup region 7 is 90%.

The converted elastic power X calculated according to Formula 1 is 90%. As described above, the converted elastic power X is used to evaluate the elasticity of the cleaning blade 5 as a whole.

In Configuration 1, the converted elastic power X is within the range defined in the present embodiment, namely, in the range of from 57% to 90%. The cleaning capability was rated as excellent. That is, defective cleaning did not occur.

Configurations 2 Through 16

Similar to Configuration 1, the converted elastic power X is within the range of from 57% to 90%. The cleaning capability was rated as one of excellent, good, and acceptable. That is, defective cleaning did not occur.

Comparative Examples 1 Through 12

Differently from Configurations 1 through 16, the converted elastic power X is out of the range of from 57% to 90%.

The cleaning capability was rated as poor. That is, the trace of defective cleaning is recognizable. Practically, the outputs images are deemed substandard.

From the verification results, setting the converted elastic power X to the range of from 57% to 90% is advantageous in inhibiting the degradation of the follow-up capability and degradation of cleaning capability due to the fatigue of the cleaning blade 5, which occur when the elasticity of the entire cleaning blade 5 is relatively low. Such setting of the converted elastic power X also inhibits chipping of the edge 61 of the cleaning blade 5 due to stick-slip, which occurs when the elasticity (the converted elastic power X) of the cleaning blade 5 is relatively high.

By contrast, according to the verification results, the above-described inconveniences can occur when the converted elastic power X is out of the range of from 57% to 90% in the cleaning blade 5 used in an electrophotographic image forming apparatus.

Embodiment 2

The cleaning blade 5 according to Embodiment 2, usable in the above-described cleaning device 1, is described.

The cleaning blade 5 according to Embodiment 2 is different from the cleaning blade 5 according to Embodiment 1 in that the minimum of the Martens hardness $h_A$ of the edge region 6 is specified as 1.5 N/mm$^2$.

Accordingly, redundant descriptions about structures similar to Embodiment 1 and action and effects thereof are omitted. Unless it is necessary to distinguish, the same reference characters are given to the same or similar elements in the descriptions below.

The cleaning blade 5 according to the present embodiment has, in addition to the feature that the converted elastic power X defined by Formula 1 is in the range of from 57% to 90%, the feature that the Martens hardness $h_A$ of the edge region 6 is 1.5 N/mm$^2$ or greater.

Setting the Martens hardness $h_A$ of the edge region 6 as described above can attain the following effect.

When the hardness of the edge 61 is low, toner external additives tend to adhere to the surface of the photoconductor 10 and solidify thereon over time, which is a phenomenon called "filming". Filming can cause image failures.

By contrast, when the Martens hardness $h_A$ of the edge region 6 including the edge 61 is set to 1.5 N/mm$^2$ or greater, the toner external additives are inhibited from adhering to the surface of the photoconductor 10, thereby inhibiting the occurrence of filming.

Next, a verification experiment performed to ascertain effects attained by examples of the cleaning blade 5 according to the present embodiment is described.

Evaluation of Short Voids and Filming

The inhibition of short streaky void and filming was evaluated under the following conditions. The term "short voids" in this specification means a white streak or streaks shaped like a small fish in an image, caused by toner additives adhering to the photoconductor.

As a test machine (an image forming apparatus), Ricoh MPC 3503 was used. In the test machine, the cleaning blade 5 of the process cartridge 121 illustrated in FIG. 2 was replaced with each of the cleaning blades according to Configurations 1 through 16 and Comparative examples 1 through 4 listed in Table 2.

As the test conditions, the image was consecutively printed on 20,000 sheets in a hot environment (with a temperature of 32° C. and a humidity of 54%). An image having an image area rate of 5% was output on A4-size sheets.

The inhibition of short voids and filming was rated in four grades of "Excellent", "Good", "Acceptable", and "Poor" in the following manner.

Excellent: Short voids and the trace of filming on the output images are not observed with eyes, and image failure is not recognized. The external additives adhering to the photoconductor 10 are hardly observed.

Good: Short voids and the trace of filming are not observed with eyes on the output images, and image failure is not recognized. However, a small amount of external additives adhering to the photoconductor 10 is observed.

Acceptable: Short voids and the trace of filming are not observed with eyes on the output images, and image failure is not recognized. However, adhesion of external additives to the photoconductor 10 is noticeable.

Poor: Short voids and the trace of filming are observed on the output images with eyes, and the images are degraded.

Verification Results

Evaluation results of configurations according to the present embodiment and the comparative examples are presented in Table 2 below.

TABLE 2

| | Blade type | X | $S_A$ [mm$^2$] | $S_B$ [mm$^2$] | $e_A$ | $e_B$ | t [mm] | $h_A$ | Cleaning capability |
|---|---|---|---|---|---|---|---|---|---|
| Configuration 1 | 1 | 57 | 5.8 | 16.8 | 50 | 60 | 0.20 | 3.0 | Excellent |
| Configuration 2 | 2 | 57 | 6.3 | 16.3 | 50 | 60 | 0.50 | 3.0 | Excellent |
| Configuration 3 | 3 | 57 | 0.2 | 22.3 | 50 | 57 | 0.10 | 5.0 | Excellent |
| Configuration 4 | 4 | 57 | 0.2 | 22.3 | 50 | 57 | 0.10 | 5.0 | Excellent |
| Configuration 5 | 1 | 75 | 5.8 | 16.8 | 60 | 80 | 0.20 | 2.0 | Good |
| Configuration 6 | 2 | 74 | 6.3 | 16.3 | 60 | 80 | 0.50 | 2.0 | Good |
| Configuration 7 | 3 | 80 | 0.2 | 22.3 | 60 | 80 | 0.10 | 2.0 | Good |
| Configuration 8 | 4 | 80 | 0.2 | 22.3 | 60 | 80 | 0.10 | 2.0 | Good |
| Configuration 9 | 1 | 77 | 5.8 | 16.8 | 70 | 80 | 0.20 | 1.5 | Acceptable |
| Configuration 10 | 2 | 77 | 6.3 | 16.3 | 70 | 80 | 0.50 | 1.5 | Acceptable |
| Configuration 11 | 3 | 80 | 0.2 | 22.3 | 70 | 80 | 0.10 | 1.5 | Acceptable |
| Configuration 12 | 4 | 80 | 0.2 | 22.3 | 70 | 80 | 0.10 | 1.5 | Acceptable |
| Configuration 13 | 1 | 90 | 1.4 | 21.1 | 80 | 91 | 0.05 | 1.5 | Acceptable |
| Configuration 14 | 2 | 90 | 6.3 | 16.3 | 83 | 92 | 0.50 | 1.5 | Acceptable |
| Configuration 15 | 3 | 90 | 0.2 | 22.3 | 80 | 90 | 0.09 | 1.5 | Acceptable |
| Configuration 16 | 4 | 90 | 0.2 | 22.3 | 80 | 90 | 0.09 | 1.5 | Acceptable |
| CMP example 1 | 1 | 81 | 1.4 | 21.1 | 90 | 80 | 0.05 | 0.9 | Poor |
| CMP example 2 | 2 | 83 | 6.3 | 16.3 | 90 | 80 | 0.50 | 0.8 | Poor |
| CMP example 3 | 3 | 80 | 0.2 | 22.3 | 90 | 80 | 0.09 | 1.0 | Poor |
| CMP example 4 | 4 | 80 | 0.2 | 22.3 | 90 | 80 | 0.09 | 1.0 | Poor |

Configuration 1

The blade type used is Blade type 1 illustrated in FIG. 4A. The edge region 6 including the edge 61 has a cross-sectional area $S_A$ of 5.8 mm$^2$, the backup region 7 has a cross-sectional area $S_B$ of 16.8 mm$^2$, the elastic power $e_A$ of the edge region 6 is 50%, and the elastic power $e_B$ of the backup region 7 is 60%.

The converted elastic power X calculated according to Formula 1 is 57%. As described above, the converted elastic power X is used to evaluate the elasticity of the cleaning blade 5 as a whole.

The converted elastic power X of Configuration 1 satisfies the range specified in Embodiment 1 (from 57% to 90%).

In Configuration 1, the Martens hardness $h_A$ of the edge region 6 is 3.0 N/mm$^2$ and satisfies the range specified in the present embodiment (greater than or equal to 1.5 N/mm$^2$). Inhibition of short voids and filming was rated as excellent. That is, short voids and filming did not occur.

Configurations 2 Through 16

Similar to Configuration 1, the converted elastic power X of the cleaning blade 5 satisfies the range of from 57% to 90%.

Similar to Configuration 1, the Martens hardness $h_A$ of the edge region 6 satisfies the specified range (greater than or equal to 1.5 N/mm$^2$). Inhibition of short voids and filming was rated as one of excellent, good, and acceptable. That is, short voids and the trace of filming were not observed on the images.

Comparative Examples 1 Through 4

Differently from Configurations 1 through 16, the converted elastic power X is out of the range of from 57% to 90%.

The Martens hardness $h_A$ of the edge region 6 is smaller than the specified range (greater than or equal to 1.5 N/mm$^2$). Inhibition of short voids and filming was rated as poor. That is, short voids and filming occurred and images were degraded.

According to the above verification results, the combination of the features of Embodiment 1 and the feature that the Martens hardness $h_A$ of the edge region 6 is greater than or equal to 1.5 N/mm$^2$ is advantageous in inhibiting adhesion of toner external additives to the surface of the photoconductor 10 and accordingly inhibiting the occurrence of filming.

By contrast, according to the above verification results, when the edge 61 has a relatively low hardness, toner external additives adhere to the surface of the photoconductor 10 and solidify thereon over time. Consequently, image failure such as short voids and filming occur.

Embodiment 3

The cleaning blade 5 according to Embodiment 3, usable in the above-described cleaning device 1, is described.

The cleaning blade 5 according to present embodiment is different from the cleaning blade 5 according Embodiment 1 in that the relation between the Martens hardness $h_A$ of the edge region 6 and the Martens hardness $h_B$ of the backup region 7 is specified.

Accordingly, redundant descriptions about structures similar to Embodiment 1 and action and effects thereof are omitted. Unless it is necessary to distinguish, the same reference characters are given to the same or similar elements in the descriptions below.

The cleaning blade 5 according to the present embodiment has, in addition to the feature that the converted elastic power X defined by Formula 1 is in the range of from 57% to 90%, the feature that the Martens hardness $h_A$ of the edge region 6 is greater than the Martens hardness $h_B$ of the backup region 7.

Such a relation between the Martens hardness $h_A$ of the edge region 6 and the Martens hardness $h_B$ of the backup region 7 can attain the following effect.

The backup region 7 being higher in hardness than the edge region 6, which includes the edge 61, means that the backup region 7 has a high hardness. Accordingly, the capability to follow the surface unevenness of the photoconductor 10 is reduced, and the cleaning blade 5 fails to remove the toner (toner escapes the cleaning blade 5, which is hereinafter also referred to as "toner escaping"). Additionally, the hardness of the edge 61 is relatively low, and the edge 61 is chipped due to stick-slip.

By contact, when the edge region 6 is higher in hardness than backup region 7, the inconveniences such as toner escaping and chipping of the edge 61 are inhibited.

Next, a verification experiment performed to ascertain effects attained by examples of the cleaning blade 5 according to the present embodiment is described.

Evaluation of Cleaning Capability

The cleaning capability was evaluated under the following conditions.

As a test machine (an image forming apparatus), Ricoh MPC 3503 was used. In the test machine, the cleaning blade 5 of the process cartridge 121 illustrated in FIG. 2 was replaced with each of the cleaning blades according to Configurations 1 through 16 and Comparative examples 1 through 4 listed in Table 3.

The test machine was left unused for 24 hours in the cold environment (with a temperature of 10° C. and a humidity of 15%), and then images were successively output on 30,000 sheets. To input a greater amount of toner to the photoconductor 10, a solid image extending entirely on A4 size was input.

The cleaning capability was rated in four grades of "Excellent", "Good", "Acceptable", and "Poor" in the following manner.

Excellent: After output of 30,000 sheets, the trace of defective cleaning is not observed on the recording sheets, and practically there are no problems. Defective cleaning does not occur even under a severe condition in which the charging current is increased, which is a harsh condition for cleaning.

Good: After output of 30,000 sheets, the trace of defective cleaning is not observed on the recording sheets, and practically there are no problems.

Acceptable: No trace of defective cleaning is observed on the recording sheets after output of 30,000 sheets. Although there is no practical disadvantage, toner escaping the cleaning blade 5 on the photoconductor 10 is observed with eyes.

Poor: After output of 30,000 sheets, the trace of defective cleaning is observed on the recording sheets, and the outputs images are practically substandard.

Verification Results

Evaluation results of configurations according to the present embodiment and the comparative examples are presented in Table 3 below.

TABLE 3

| | Blade type | X | $S_A$ [mm$^2$] | $S_B$ [mm$^2$] | $e_A$ | $e_B$ | t [mm] | $h_A$ | $h_B$ | Cleaning capability |
|---|---|---|---|---|---|---|---|---|---|---|
| Configuration 1 | 1 | 57 | 5.8 | 16.8 | 50 | 60 | 0.20 | 3.0 | 0.7 | Excellent |
| Configuration 2 | 2 | 57 | 6.3 | 16.3 | 50 | 60 | 0.50 | 3.0 | 0.7 | Excellent |
| Configuration 3 | 3 | 57 | 0.2 | 22.3 | 50 | 57 | 0.10 | 5.0 | 0.7 | Excellent |
| Configuration 4 | 4 | 57 | 0.2 | 22.3 | 50 | 57 | 0.10 | 5.0 | 0.7 | Excellent |
| Configuration 5 | 1 | 75 | 5.8 | 16.8 | 60 | 80 | 0.20 | 2.0 | 0.9 | Good |
| Configuration 6 | 2 | 74 | 6.3 | 16.3 | 60 | 80 | 0.50 | 2.0 | 0.9 | Good |
| Configuration 7 | 3 | 80 | 0.2 | 22.3 | 60 | 80 | 0.10 | 2.0 | 0.9 | Good |
| Configuration 8 | 4 | 80 | 0.2 | 22.3 | 60 | 80 | 0.10 | 2.0 | 0.9 | Good |
| Configuration 9 | 1 | 77 | 5.8 | 16.8 | 70 | 80 | 0.20 | 1.5 | 1.0 | Acceptable |
| Configuration 10 | 2 | 77 | 6.3 | 16.3 | 70 | 80 | 0.50 | 1.5 | 1.0 | Acceptable |
| Configuration 11 | 3 | 80 | 0.2 | 22.3 | 70 | 80 | 0.10 | 1.5 | 1.0 | Acceptable |
| Configuration 12 | 4 | 80 | 0.2 | 22.3 | 70 | 80 | 0.10 | 1.5 | 1.0 | Acceptable |
| Configuration 13 | 1 | 90 | 1.4 | 21.1 | 80 | 91 | 0.05 | 1.5 | 1.0 | Acceptable |
| Configuration 14 | 2 | 90 | 6.3 | 16.3 | 83 | 92 | 0.50 | 1.5 | 1.0 | Acceptable |
| Configuration 15 | 3 | 90 | 0.2 | 22.3 | 80 | 90 | 0.09 | 1.5 | 1.0 | Acceptable |
| Configuration 16 | 4 | 90 | 0.2 | 22.3 | 80 | 90 | 0.09 | 1.5 | 1.0 | Acceptable |
| CMP example 1 | 1 | 71 | 1.4 | 21.1 | 90 | 70 | 0.05 | 1.5 | 3.0 | Poor |
| CMP example 2 | 2 | 76 | 6.3 | 16.3 | 90 | 70 | 0.50 | 1.5 | 3.0 | Poor |
| CMP example 3 | 3 | 70 | 0.2 | 22.3 | 90 | 70 | 0.09 | 1.5 | 3.0 | Poor |
| CMP example 4 | 4 | 70 | 0.2 | 22.3 | 90 | 70 | 0.09 | 1.5 | 3.0 | Poor |

Configuration 1

The blade type used is Blade type 1 illustrated in FIG. 4A. The edge region 6 including the edge 61 has a cross-sectional area $S_A$ of 5.8 mm$^2$, the backup region 7 has a cross-sectional area $S_B$ of 16.8 mm$^2$, the elastic power $e_A$ of the edge region 6 is 50%, and the elastic power $e_B$ of the backup region 7 is 60%

The converted elastic power X calculated according to Formula 1 is 57%. As described above, the converted elastic power X is used to evaluate the elasticity of the cleaning blade 5 as a whole.

The converted elastic power X of Configuration 1 satisfies the range specified in Embodiment 1 (from 57% to 90%).

The Martens hardness $h_A$ of the edge region 6 including the edge 61 is greater than the Martens hardness $h_B$ of the backup region 7. Cleaning capability was rated as excellent. That is, defective cleaning did not occur.

Configurations 2 Through 16

Similar to Configuration 1, the converted elastic power X of the cleaning blade 5 satisfies the range of from 57% to 90%.

Similar to Configuration 1, the Martens hardness $h_A$ of the edge region 6 including the edge 61 is greater than the Martens hardness $h_B$ of the backup region 7. Cleaning capability was rated as one of excellent, good, and acceptable. That is, defective cleaning did not occur.

Comparative Examples 1 Through 4

Similar to Configuration 1, the converted elastic power X of the cleaning blade 5 satisfies the range of from 57% to 90%.

Differently from Configuration 1, the Martens hardness $h_A$ of the edge region 6 including the edge 61 is smaller than the Martens hardness $h_B$ of the backup region 7. Cleaning capability was rated as poor, and the images were defective.

According to the above verification results, the combination of the features of Embodiment 1 and the Martens hardness $h_A$ of the edge region 6 being greater than the Martens hardness $h_B$ of the backup region 7 is advantageous in inhibiting the above-described inconveniences, such as toner escaping and chipping of the edge 61.

By contrast, according to the above verification results, when the backup region 7 is higher in hardness than the edge region 6, the backup region 7 has a high hardness to degrade the capability to follow the surface unevenness of the photoconductor 10, allowing the toner to escape the cleaning blade 5.

Also known from the verification results is that the edge 61 can be chipped due to stick-slip when the hardness of the edge 61 is relatively low.

Embodiment 4

The cleaning blade 5 according to Embodiment 4, usable in the above-described cleaning device 1, is described.

The cleaning blade 5 according to the present is different from the cleaning blade 5 according to Embodiment 1 in that the elastic power $e_A$ of the edge region 6 is greater than or equal to 50%.

Accordingly, redundant descriptions about structures similar to Embodiment 1 and action and effects thereof are omitted. Unless it is necessary to distinguish, the same reference characters are given to the same or similar elements in the descriptions below.

The cleaning blade 5 according to the present embodiment has, in addition to the feature that the converted elastic power X defined by Formula 1 is in the range of from 57% to 90%, the feature that the elastic power $e_A$ of the edge region 6 is greater than or equal to 50%, which attains the following effect.

In the cleaning blade 5, when the edge region 6 including the edge 61 has a relatively low elasticity, the edge 61 may be abraded or chipped, resulting in defective cleaning. By contrast, when the elastic power $e_A$ of the edge region 6 is greater than or equal to 50%, abrasion and chipping of the edge 61 can be inhibited, thereby inhibiting defective cleaning.

Next, a verification experiment performed to ascertain effects attained by examples of the cleaning blade 5 according to the present embodiment is described.

Evaluation of Cleaning Capability

The cleaning capability was evaluated under the following conditions.

As a test machine (an image forming apparatus), Ricoh MPC 3503 was used. In the test machine, the cleaning blade 5 of the process cartridge 121 illustrated in FIG. 2 was replaced with each of the cleaning blades according to Configurations 1 through 12 and Comparative examples 1 through 4 listed in Table 4.

The test machine was left unused for 24 hours in the cold environment (with a temperature of 10° C. and a humidity of 15%), and then images were successively output on 30,000 sheets. To input a greater amount of toner to the photoconductor 10, a solid image extending entirely on A4 size was input.

The cleaning capability was rated in four grades of "Excellent", "Good", "Acceptable", and "Poor" in the following manner.

Excellent: After output of 30,000 sheets, the trace of defective cleaning is not observed on the recording sheets, and practically there are no problems. Defective cleaning does not occur even under a severe condition in which the charging current is increased, which is a harsh condition for cleaning.

Good: After output of 30,000 sheets, the trace of defective cleaning is not observed on the recording sheets, and practically there are no problems.

Acceptable: No trace of defective cleaning is observed on the recording sheets after output of 30,000 sheets. Although there is no practical disadvantage, toner escaping the cleaning blade 5 on the photoconductor 10 is observed with eyes.

Poor: After output of 30,000 sheets, the trace of defective cleaning is observed on the recording sheets, and the outputs images are practically substandard.

Verification Results

Evaluation results of configurations according to the present embodiment and the comparative examples are presented in Table 4 below.

TABLE 4

| | Blade type | X | $S_A$ [mm$^2$] | $S_B$ [mm$^2$] | $e_A$ | $e_B$ | t [mm] | Cleaning capability |
|---|---|---|---|---|---|---|---|---|
| Configuration 1 | 1 | 89 | 1.4 | 21.1 | 80 | 90 | 0.05 | Excellent |
| Configuration 2 | 2 | 87 | 6.3 | 16.3 | 80 | 90 | 0.50 | Excellent |
| Configuration 3 | 3 | 90 | 0.2 | 22.3 | 80 | 90 | 0.09 | Excellent |
| Configuration 4 | 4 | 90 | 0.2 | 22.3 | 80 | 90 | 0.09 | Excellent |
| Configuration 5 | 1 | 76 | 4.9 | 17.6 | 60 | 80 | 0.17 | Good |
| Configuration 6 | 2 | 74 | 6.3 | 16.3 | 60 | 80 | 0.50 | Good |
| Configuration 7 | 3 | 80 | 0.2 | 22.3 | 60 | 80 | 0.09 | Good |
| Configuration 8 | 4 | 80 | 0.2 | 22.3 | 60 | 80 | 0.09 | Good |
| Configuration 9 | 1 | 73 | 4.9 | 17.6 | 50 | 80 | 0.17 | Acceptable |
| Configuration 10 | 2 | 72 | 6.3 | 16.3 | 50 | 80 | 0.50 | Acceptable |
| Configuration 11 | 3 | 80 | 0.2 | 22.3 | 50 | 80 | 0.09 | Acceptable |
| Configuration 12 | 4 | 80 | 0.2 | 22.3 | 50 | 80 | 0.09 | Acceptable |
| CMP example 1 | 1 | 71 | 4.9 | 17.6 | 40 | 80 | 0.17 | Poor |
| CMP example 2 | 2 | 69 | 6.3 | 16.3 | 40 | 80 | 0.50 | Poor |
| CMP example 3 | 3 | 80 | 0.2 | 22.3 | 40 | 80 | 0.09 | Poor |
| CMP example 4 | 4 | 80 | 0.2 | 22.3 | 40 | 80 | 0.09 | Poor |

Configuration 1

The blade type used is Blade type 1 illustrated in FIG. 4A. The edge region 6 including the edge 61 has a cross-sectional area $S_A$ of 1.4 $mm^2$, the backup region 7 has a cross-sectional area $S_B$ of 21.1 $mm^2$, the elastic power c of the edge region 6 is 80%, and the elastic power $e_B$ of the backup region 7 is 90%.

The converted elastic power X calculated according to Formula 1 is 89%. As described above, the converted elastic power X is used to evaluate the elasticity of the cleaning blade 5 as a whole.

The converted elastic power X of Configuration 1 satisfies the range specified in Embodiment 1 (from 57% to 90%).

In Configuration 1, the elastic power $e_A$ of the edge region 6 including the edge 61 is 80% (greater than 50%). Cleaning capability was rated as excellent. That is, defective cleaning did not occur.

Configurations 2 Through 12

Similar to Configuration 1, the converted elastic power X of the cleaning blade 5 satisfies the range of from 57% to 90%.

Similar to Configuration 1, the elastic power $e_A$ of the edge region 6 including the edge 61 is greater than 50%. Cleaning capability was rated as one of excellent, good, and acceptable. That is, defective cleaning did not occur.

Comparative Examples 1 Through 4

Similar to Configuration 1, the converted elastic power X of the cleaning blade 5 satisfies the range of from 57% to 90%.

Differently from Configurations 1 through 12, the elastic power $e_A$ of the edge region 6 including the edge 61 is smaller than 50%. Cleaning capability was rated as poor. Cleaning was defective, and the images were substandard.

According to the above verification results, the combination of the features of Embodiment 1 and the feature that the elastic power $e_A$ of the edge region 6 is greater than or equal to 50% is advantageous in inhibiting defective cleaning caused by the abrasion and chipping of the edge 61.

Also known from the verification results is that, when the edge region 6 including the edge 61 has a relatively low elasticity, the possibility of defective cleaning, caused by the abrasion and chipping of the edge 61, increases.

Embodiment 5

The cleaning blade 5 according to Embodiment 5, usable in the above-described cleaning device 1, is described.

The cleaning blade 5 according to the present is different from the cleaning blade 5 according to Embodiment 1 in that the elastic power $e_B$ of the backup region 7 is greater than or equal to 60%.

Accordingly, redundant descriptions about structures similar to Embodiment 1 and action and effects thereof are omitted. Unless it is necessary to distinguish, the same reference characters are given to the same or similar elements in the descriptions below.

The cleaning blade 5 according to the present embodiment has, in addition to the feature that the converted elastic power X defined by Formula 1 is in the range of from 57% to 90%, the feature that the elastic power $e_B$ of the backup region 7 is greater than or equal to 60%.

Setting the elastic power $e_B$ of the backup region 7 as described above can attain the following effect.

When the elastic power $e_B$ of the backup region 7 is low, the contact pressure is not maintained, and the toner may escape the cleaning blade 5.

By contrast, when the elastic power $e_B$ of the backup region 7 is greater than or equal to 60%, toner escaping caused by an insufficient contact pressure can be inhibited.

Next, a verification experiment performed to ascertain effects attained by examples of the cleaning blade 5 according to the present embodiment is described.

Evaluation of Cleaning Capability

The cleaning capability was evaluated under the following conditions.

As a test machine (an image forming apparatus), Ricoh MPC 3503 was used. In the test machine, the cleaning blade 5 of the process cartridge 121 illustrated in FIG. 2 was replaced with each of the cleaning blades according to Configurations 1 through 12 and Comparative examples 1 through 4 listed in Table 5.

The test machine was left unused for 24 hours in the cold environment (with a temperature of 10° C. and a humidity of 15%), and then images were successively output on 30,000 sheets. To input a greater amount of toner to the photoconductor 10, a solid image extending entirely on A4 size was input.

The cleaning capability was rated in four grades of "Excellent", "Good", "Acceptable", and "Poor" in the following manner.

Excellent: After output of 30,000 sheets, the trace of defective cleaning is not observed on the recording sheets, and practically there are no problems. Defective cleaning does not occur even under a severe condition in which the charging current is increased, which is a harsh condition for cleaning.

Good: After output of 30,000 sheets, the trace of defective cleaning is not observed on the recording sheets, and practically there are no problems.

Acceptable: No trace of defective cleaning is observed on the recording sheets after output of 30,000 sheets. Although there is no practical disadvantage, toner escaping the cleaning blade 5 on the photoconductor 10 is observed with eyes.

Poor: After output of 30,000 sheets, the trace of defective cleaning is observed on the recording sheets, and the outputs images are practically substandard.

Verification Results

Evaluation results of configurations according to the present embodiment and the comparative examples are presented in Table 5 below.

TABLE 5

| | Blade type | X | $S_A$ [$mm^2$] | $S_B$ [$mm^2$] | $e_A$ | $e_B$ | t [mm] | Cleaning capability |
|---|---|---|---|---|---|---|---|---|
| Configuration 1 | 1 | 89 | 1.4 | 21.1 | 80 | 90 | 0.05 | Excellent |
| Configuration 2 | 2 | 88 | 3.0 | 16.3 | 80 | 90 | 0.24 | Excellent |
| Configuration 3 | 3 | 90 | 0.5 | 22.3 | 80 | 90 | 0.09 | Excellent |
| Configuration 4 | 4 | 90 | 0.5 | 22.3 | 80 | 90 | 0.09 | Excellent |
| Configuration 5 | 1 | 73 | 5.8 | 16.8 | 80 | 70 | 0.20 | Excellent |
| Configuration 6 | 2 | 73 | 6.3 | 16.3 | 80 | 70 | 0.50 | Excellent |
| Configuration 7 | 3 | 70 | 0.2 | 22.3 | 80 | 70 | 0.10 | Good |
| Configuration 8 | 4 | 70 | 0.2 | 22.3 | 80 | 70 | 0.10 | Good |
| Configuration 9 | 1 | 57 | 5.8 | 16.8 | 50 | 60 | 0.20 | Acceptable |
| Configuration 10 | 2 | 57 | 6.3 | 16.3 | 50 | 60 | 0.50 | Acceptable |
| Configuration 11 | 3 | 60 | 0.2 | 22.3 | 50 | 60 | 0.10 | Acceptable |
| Configuration 12 | 4 | 60 | 0.2 | 22.3 | 50 | 60 | 0.10 | Acceptable |
| CMP example 1 | 1 | 53 | 5.8 | 16.8 | 60 | 50 | 0.20 | Poor |
| CMP example 2 | 2 | 53 | 6.3 | 16.3 | 60 | 50 | 0.50 | Poor |

TABLE 5-continued

| | Blade type | X | $S_A$ [mm$^2$] | $S_B$ [mm$^2$] | $e_A$ | $e_B$ | t [mm] | Cleaning capability |
|---|---|---|---|---|---|---|---|---|
| CMP example 3 | 3 | 50 | 0.2 | 22.3 | 60 | 50 | 0.10 | Poor |
| CMP example 4 | 4 | 50 | 0.2 | 22.3 | 60 | 50 | 0.10 | Poor |

Configuration 1

The blade type used is Blade type 1 illustrated in FIG. 4A. The edge region 6 including the edge 61 has a cross-sectional area $S_A$ of 1.4 mm$^2$, the backup region 7 has a cross-sectional area $S_B$ of 21.1 mm$^2$, the elastic power $e_A$ of the edge region 6 is 80%, and the elastic power $e_B$ of the backup region 7 is 90%.

The converted elastic power X calculated according to Formula 1 is 89%. As described above, the converted elastic power X is used to evaluate the elasticity of the cleaning blade 5 as a whole.

The converted elastic power X of Configuration 1 satisfies the range specified in Embodiment 1 (front 57% to 90%).

In Configuration 1, the elastic power $e_B$ of the backup region 7 is 90% (greater than 60%). Cleaning capability was rated as excellent. That is, defective cleaning did not occur.

Configurations 2 Through 12

Similar to Configuration 1, the converted elastic power X of the cleaning blade satisfies the range of from 57% to 90%.

Similar to Configuration 1, the elastic power $e_B$ of the backup region 7 is greater than 60%. Cleaning capability was rated as one of excellent, good, and acceptable. That is, defective cleaning did not occur.

Comparative Examples 1 Through 4

Differently from Configuration 1, the converted elastic power X of the cleaning blade 5 is smaller than 57%, and the elastic power $e_B$ of the backup region 7 is smaller than 60%. The cleaning capability was rated as poor. That is, defective cleaning is recognizable. Practically, the outputs images are deemed substandard.

According to the above verification results, the combination of the features of Embodiment 1 and the feature that the elastic power $e_B$ of the backup region 7 is greater than or equal to 60% is advantageous in inhibiting toner escaping caused by an insufficient contact pressure.

Also known from the verification results is that, when the elastic power $e_B$ of the backup region 7 is low, the cleaning blade 5 fails to maintain the contact pressure, allowing the toner to escape the cleaning blade 5.

Embodiment 6

The cleaning blade 5 according to Embodiment 6, usable in the above-described cleaning device 1, is described.

In Embodiment 6, the cleaning blade 5 has the feature according to Embodiment 1 (the converted elastic power X defined by Formula 1 ranges from 57% to 90%), the feature according to Embodiment 2 (the minimum of the Martens hardness $h_A$ of the edge region 6 is 1.5 N/mm$^2$), and the feature according to Embodiment 3 (the Martens hardness $h_A$ of the edge region 6 is greater than the Martens hardness $h_B$ of the backup region 7).

Further, in Embodiment 6, Blade type and the range of the edge region thickness t is specified.

Accordingly, redundant descriptions about structures similar to Embodiments 1 through 3 and action and effects thereof are omitted. Unless it is necessary to distinguish, the same reference characters are given to the same or similar elements in the descriptions below.

Specifically, in Blade type 1 illustrated in FIG. 4A, the edge region thickness t is in a range of from 0.05 mm to 0.20 mm.

Setting the blade type and the edge region thickness t as described above can attain the following effect.

In Blade type 1, if the edge region thickness t is smaller than 0.05 mm, the backup region 7 is exposed as the edge 61 is abraded. Then, the cleaning capability is degraded. If the edge region thickness t of Blade type 1 is greater than 0.20 mm, the percentage of the low-hardness region is relatively large. Then, the cleaning blade 5 is liable to fatigue.

When the edge region thickness t of Blade type 1 is in the range of from 0.05 mm to 0.20 mm, degradation of cleaning capability and fatigue are suppressed.

Next, a verification experiment performed to ascertain effects attained by examples of the cleaning blade 5 according to the present embodiment is described.

Evaluation of Cleaning Capability

The cleaning capability was evaluated under the following conditions.

As a test machine (an image forming apparatus), Ricoh MPC 3503 was used. In the test machine, the cleaning blade 5 of the process cartridge 121 illustrated in FIG. 2 was replaced with each of the cleaning blades according to Configurations 1 through 12 and Comparative examples 1 through 4 listed in Table 6.

The test machine was left unused for 24 hours in the cold environment (with a temperature of 10° C. and a humidity of 15%), and then images were successively output on 30,000 sheets. To input a greater amount of toner to the photoconductor 10, a solid image extending entirely on A4 size was input.

The cleaning capability was rated in four grades of "Excellent", "Good", "Acceptable", and "Poor" in the following manner.

Excellent: After output of 30,000 sheets, the trace of defective cleaning is not observed on the recording sheets, and practically there are no problems. Defective cleaning does not occur even under a severe condition in which the charging current is increased, which is a harsh condition for cleaning.

Good: After output of 30,000 sheets, the trace of defective cleaning is not observed on the recording sheets, and practically there are no problems.

Acceptable: No trace of defective cleaning is observed on the recording sheets after output of 30,000 sheets. Although there is no practical disadvantage, toner escaping the cleaning blade 5 on the photoconductor 10 is observed with eyes.

Poor: After output of 30,000 sheets, the trace of defective cleaning is observed on the recording sheets, and the outputs images are practically substandard.

Verification Results

Evaluation results of configurations according to the present embodiment and the comparative examples are presented in Table 6 below.

TABLE 6

| | Blade type | X | $S_A$ [mm$^2$] | $S_B$ [mm$^2$] | $e_A$ | $e_B$ | t [mm] | $h_A$ | $h_B$ | Cleaning capability |
|---|---|---|---|---|---|---|---|---|---|---|
| Configuration 1 | 1 | 89 | 1.4 | 21.1 | 70 | 90 | 0.05 | 3.0 | 0.7 | Excellent |
| Configuration 2 | 1 | 87 | 2.9 | 19.6 | 70 | 90 | 0.10 | 3.0 | 0.7 | Excellent |
| Configuration 3 | 1 | 86 | 4.3 | 18.2 | 70 | 90 | 0.15 | 3.0 | 0.7 | Excellent |
| Configuration 4 | 1 | 85 | 5.8 | 16.8 | 70 | 90 | 0.20 | 3.0 | 0.7 | Good |
| CMP example 1 | 1 | 90 | 0.3 | 22.2 | 70 | 90 | 0.01 | 3.0 | 0.7 | Poor |
| CMP example 2 | 1 | 90 | 0.3 | 16.0 | 70 | 90 | 0.01 | 3.0 | 0.7 | Poor |
| CMP example 3 | 1 | 82 | 8.6 | 13.9 | 70 | 90 | 0.30 | 3.0 | 0.7 | Poor |
| CMP example 4 | 1 | 80 | 11.5 | 11.0 | 70 | 90 | 0.40 | 3.0 | 0.7 | Poor |

Configuration 1

The blade type used is Blade type 1 illustrated in FIG. 4A. The edge region 6 including the edge 61 has a cross-sectional area $S_A$ of 1.4 mm$^2$, the backup region 7 has cross-sectional area $S_B$ of 21.1 mm$^2$, the elastic power $e_A$ of the edge region 6 is 70%, and the elastic power $e_B$ of the backup region 7 is 90%.

The converted elastic power X calculated according to Formula 1 is 89%. As described above, the converted elastic power X is used to evaluate the elasticity of the cleaning blade 5 as a whole.

The converted elastic power X of Configuration 1 satisfies the range specified in Embodiment 1 (from 57% to 90%).

In Configuration 1, the edge region thickness t is 0.05 mm and satisfies the specified range of from 0.05 mm to 0.20 mm. Cleaning capability was rated as excellent. That is, defective cleaning did not occur.

Configurations 2 Through 4

Similar to Configuration 1, the converted elastic power X of the cleaning blade 5 satisfies the range of from 57% to 90%.

Similar to Configuration 1, the edge region thickness t satisfies the specified range of from 0.05 mm to 0.20 mm. Cleaning capability was rated as either excellent or good. That is, defective cleaning did not occur.

Comparative Examples 1 Through 4

Similar to Configuration 1, the converted elastic you X of the cleaning blade 5 satisfies the range of from 57% to 90%.

However, the edge region thickness t is out of the range of from 0.05 mm to 0.20 mm. The cleaning capability was rated as, poor. That is, defective cleaning is recognizable Practically, the outputs images are deemed substandard.

The above verification results confirm the following.

In Blade type 1, if the edge region thickness t is smaller than 0.05 mm, the backup region 7 is exposed as the edge 61 is abraded. Then, the cleaning capability is degraded. If the edge region thickness t of Blade type 1 is greater than 0.20 mm, the percentage of the low-hardness region is relatively large. Then, the cleaning blade 5 is liable to fatigue.

By contrast, the combination of the features of Embodiment 1 and the feature that the edge region thickness t of Blade type 1 ranges from 0.05 mm to 0.20 mm can suppress the degradation of cleaning capability and fatigue of the cleaning blade 5.

Embodiment 7

The cleaning blade 5 according to Embodiment 7, usable in the above-described cleaning device 1, is described.

In Embodiment 6, the cleaning blade 5 has the features according to Embodiments 1, 2, and 3. Further, in Embodiment 6, Blade type and the range of the edge region thickness t is specified.

Accordingly, redundant descriptions about structures similar to Embodiments 1 through 3 and action and effects thereof are omitted. Unless it is necessary to distinguish, the same reference characters are given to the same or similar elements in the descriptions below.

Specifically, the cleaning blade 5 according to Embodiment 7 has, in addition to the feature according to Embodiment 1 (the converted elastic power X defined by Formula 1 ranges from 57% to 90%), features that Blade type 2 illustrated in FIG. 4B is used and the edge region thickness t is in a range of from 0.05 mm to 0.50 mm.

Setting the blade type and the edge region thickness t as described above can attain the following effect.

In Blade type 2, if the edge region thickness t is smaller than 0.05 mm, the backup region 7 is exposed as the edge 61 is abraded. Then, the cleaning capability is degraded. If the edge region thickness t of Blade type 2 is greater than 0.50 mm, the percentage of the low-hardness region is relatively large. Then, the cleaning blade 5 is liable to fatigue.

When the edge region thickness t of Blade type 2 is in the range of from 0.05 mm to 0.50 mm, degradation of cleaning capability and fatigue are suppressed.

Next, a verification experiment performed to ascertain effects attained by examples of the cleaning blade 5 according to the present embodiment is described.

Evaluation of Cleaning Capability

The cleaning capability was evaluated under the following conditions.

As a test machine (an image forming apparatus), Ricoh MPC 3503 was used. In the test machine, the cleaning blade 5 of the process cartridge 121 illustrated in FIG. 2 was replaced with each of the cleaning blades according to Configurations 1 through 7 and Comparative examples 1 through 4 listed in Table 7.

The test machine was left unused for 24 hours in the cold environment (with a temperature of 10° C. and a humidity of 15%), and then images were successively output on 30,000 sheets. To input a greater amount of toner to the photoconductor 10, a solid image extending entirely on A4 size was input.

The cleaning capability was rated in four grades of "Excellent", "Good", "Acceptable", and "Poor" in the following manner.

Excellent: After output of 30,000 sheets, the trace of defective cleaning is not observed on the recording sheets, and practically there are no problems. Defective cleaning does not occur even under a severe condition in which the charging current is increased, which is a harsh condition for cleaning.

Good: After output of 30,000 sheets, the trace of defective cleaning is not observed on the recording sheets, and practically there are no problems.

Acceptable: No trace of defective cleaning is observed on the recording sheets after output of 30,000 sheets. Although there is no practical disadvantage, toner escaping the cleaning blade 5 on the photoconductor 10 is observed with eyes.

Poor: After output of 30,000 sheets, the trace of defective cleaning is observed on the recording sheets, and the outputs images are practically substandard, Verification Results Evaluation results of configurations according to the present embodiment and the comparative examples are presented in Table 7 below

TABLE 7

| | Blade type | X | $S_A$ [mm$^2$] | $S_B$ [mm$^2$] | $e_A$ | $e_B$ | t [mm] | $h_A$ | $h_B$ | Cleaning capability |
|---|---|---|---|---|---|---|---|---|---|---|
| Configuration 1 | 2 | 89 | 0.6 | 16.3 | 70 | 90 | 0.05 | 3.0 | 0.7 | Excellent |
| Configuration 2 | 2 | 89 | 1.3 | 16.3 | 70 | 90 | 0.10 | 3.0 | 0.7 | Excellent |
| Configuration 3 | 2 | 86 | 3.8 | 16.3 | 70 | 90 | 0.30 | 3.0 | 0.7 | Excellent |
| Configuration 4 | 2 | 85 | 5.6 | 16.3 | 70 | 90 | 0.45 | 3.0 | 0.7 | Excellent |
| Configuration 5 | 2 | 84 | 6.3 | 16.3 | 70 | 90 | 0.50 | 3.0 | 0.7 | Excellent |
| Configuration 6 | 2 | 85 | 5.6 | 16.3 | 70 | 90 | 0.45 | 3.0 | 0.7 | Good |
| Configuration 7 | 2 | 84 | 6.3 | 16.3 | 70 | 90 | 0.50 | 3.0 | 0.7 | Good |
| CMP example 1 | 2 | 90 | 0.1 | 22.5 | 70 | 90 | 0.01 | 3.0 | 0.7 | Poor |
| CMP example 2 | 2 | 90 | 0.1 | 16.3 | 70 | 90 | 0.01 | 3.0 | 0.7 | Poor |
| CMP example 3 | 2 | 81 | 11.3 | 12.5 | 70 | 90 | 0.90 | 3.0 | 0.7 | Poor |
| CMP example 4 | 2 | 80 | 12.5 | 12.5 | 70 | 90 | 1.00 | 3.0 | 0.7 | Poor |

Configuration 1

The blade type used is Blade type 2 illustrated in FIG. 4B. The edge region 6 including the edge 61 has a cross-sectional area $S_A$ of 0.6 mm$^2$, the backup region 7 has a cross-sectional area $S_B$ of 16.3 mm$^2$, the elastic power $e_A$ of the edge region 6 is 70%, and the elastic power $e_B$ of the backup region 7 is 90%.

The converted elastic power X calculated according to Formula 1 is 89%. As described above, the converted elastic power X is used to evaluate the elasticity of the cleaning blade 5 as a whole.

The converted elastic power X of Configuration 1 satisfies the range specified in Embodiment 1 (from 57% to 90%).

In Configuration 1, the edge region thickness t is 0.05 mm and satisfies the specified range of from 0.05 mm to 0.50 mm. Cleaning capability was rated as excellent. That is, defective cleaning did not occur.

Configurations 2 Through 7

Similar to Configuration 1, the converted elastic power X of the cleaning blade 5 satisfies the range of from 57% to 90%.

Similar to Configuration 1, the edge region thickness t satisfies the specified range of from 0.05 mm to 0.50 mm. Cleaning capability was rated as either excellent or good. That is, defective cleaning did not occur.

Comparative Examples 1 Through 4

Similar to Configuration 1, the converted elastic power X of the cleaning blade 5 satisfies the range of from 57% to 90%.

However, the edge region thickness t is out of the range of from 0.05 mm to 0.50 mm. The cleaning capability was rated as poor. That is, defective cleaning is recognizable. Practically, the outputs images are deemed substandard.

According to the above verification results, the following is known.

In Blade type 2, if the edge region thickness t is smaller than 0.05 mm, the backup region 7 is exposed as the edge 61 is abraded. Then, the cleaning capability is degraded. If the edge region thickness t of Blade type 2 is greater than 0.50 mm, the percentage of the low-hardness region is relatively large. Then, the cleaning blade 5 fatigues.

By contrast, the combination of the feature of Embodiment 1 and the feature of the present embodiment (the edge region thickness t of Blade type 2 ranges from 0.05 mm to 0.50 mm) can suppress the degradation of cleaning capability and fatigue of the cleaning blade 5.

Embodiment 8

The cleaning blade 5 according to Embodiment 8, usable in the above-described cleaning device 1, is described.

In Embodiment 6, the cleaning blade 5 has the features according to Embodiments 1, 2, and 3. Further, in Embodiment 6, Blade type and the range of the edge region thickness t is specified.

Accordingly, redundant descriptions about structures similar to Embodiments 1 through 3 and action and effects thereof are omitted. Unless it is necessary to distinguish, the same reference characters are given to the same or similar elements in the descriptions below.

Specifically, the converted elastic power X defined by Formula 1 ranges from 57% to 90%, Blade type 3 illustrated in FIG. 4C is used, and the edge region thickness t is in a range of from 0.05 mm to 0.20 mm.

Setting the blade type and the edge region thickness t as described above can attain the following effect.

In Blade type 3, if the edge region thickness t is smaller than 0.05 mm, the backup region 7 is exposed as the edge 61 is abraded. Then, the cleaning capability is degraded. If the edge region thickness t of Blade type 3 is greater than 0.20 mm, the percentage of the low-hardness region is relatively large. Then, the cleaning blade 5 is liable to fatigue.

By contrast, when the edge region thickness t of Blade type 3 is in the range of from 0.05 mm to 0.20 mm, degradation of cleaning capability and fatigue are suppressed.

Next, a verification experiment performed to ascertain effects attained by examples of the cleaning blade 5 according to the present embodiment is described.

Evaluation of Cleaning Capability

The cleaning capability was evaluated under the following conditions.

As a test machine (an image forming apparatus), Ricoh MPC 3503 was used. In the test machine, the cleaning blade 5 of the process cartridge 121 illustrated in FIG. 2 was replaced with each of the cleaning blades according to Configurations 1 through 4 and Comparative examples 1 through 4 listed in Table 8. The blade type used is Blade type 3 illustrated in FIG. 4C.

The test machine was left unused for 24 hours in the cold environment (with a temperature of 10° C. and a humidity of 15%), and then images were successively output on 30,000 sheets. To input a greater amount of toner to the photoconductor 10, a solid image extending entirely on A4 size was input.

The cleaning capability was rated in four grades of "Excellent", "Good", "Acceptable", and "Poor" in the following manner.

Excellent: After output of 30,000 sheets, the trace of defective cleaning is not observed on the recording sheets, and practically there are no problems. Defective cleaning does not occur even under a severe condition in which the charging current is increased, which is a harsh condition for cleaning.

Good: After output of 30,000 sheets, the trace of defective cleaning is not observed on the recording sheets, and practically there are no problems.

Acceptable: No trace of defective cleaning is observed on the recording sheets after output of 30,000 sheets. Although there is no practical disadvantage, toner escaping the cleaning blade 5 on the photoconductor 10 is observed with eyes, Poor: After output of 30,000 sheets, the trace of defective cleaning is observed on the recording sheets, and the outputs images are, practically substandard.

Verification Results

Evaluation results of configurations according to the present embodiment and the comparative examples are presented in Table 8 below.

TABLE 8

| | Blade type | X | $S_A$ [mm$^2$] | $S_B$ [mm$^2$] | $e_A$ | $e_B$ | t [mm] | $h_A$ | $h_B$ | Cleaning capability |
|---|---|---|---|---|---|---|---|---|---|---|
| Configuration 1 | 3 | 90 | 0.1 | 22.4 | 70 | 90 | 0.05 | 3.0 | 0.7 | Excellent |
| Configuration 2 | 3 | 90 | 0.2 | 22.3 | 70 | 90 | 0.10 | 3.0 | 0.7 | Excellent |
| Configuration 3 | 3 | 90 | 0.3 | 22.2 | 70 | 90 | 0.15 | 3.0 | 0.7 | Excellent |
| Configuration 4 | 3 | 90 | 0.4 | 22.1 | 70 | 90 | 0.20 | 3.0 | 0.7 | Good |
| CMP example 1 | 3 | 90 | 0.0 | 22.5 | 70 | 90 | 0.01 | 3.0 | 0.7 | Poor |
| CMP example 2 | 3 | 90 | 0.0 | 16.2 | 70 | 90 | 0.01 | 3.0 | 0.7 | Poor |
| CMP example 3 | 3 | 90 | 0.5 | 22.0 | 70 | 90 | 0.30 | 3.0 | 0.7 | Poor |
| CMP example 4 | 3 | 89 | 0.7 | 21.8 | 70 | 90 | 0.40 | 3.0 | 0.7 | Poor |

Configuration 1

The edge region 6 including the edge 61 has a cross-sectional area $S_A$ of 0.1 mm$^2$, the backup region 7 has a cross-sectional area $S_B$ of 22.4 mm$^2$, the elastic power $e_A$ of the edge region 6 is 70%, and the elastic power $e_B$ of the backup region 7 is 90%.

The converted elastic power X calculated according to Formula 1 is 90% As described above, the converted elastic power X is used to evaluate the elasticity of the cleaning blade 5 as a whole.

The converted elastic power X of Configuration 1 satisfies the range specified in Embodiment 1 (from 57% to 90%).

In Configuration 1, the edge region thickness t is 0.05 mm and satisfies the specified range of from 0.05 mm to 0.20 mm. Cleaning capability was rated as excellent That is, defective cleaning did not occur.

Configurations 2 Through 4

Similar to Configuration 1, the converted elastic power X of the cleaning blade 5 satisfies the range of from 57% to 90%.

Similar to Configuration 1, the edge region thickness t satisfies the specified range of from 0.05 mm to 0.20 mm. Cleaning capability was rated as either excellent or good. That is, defective cleaning did not occur.

Comparative Examples 1 Through 4

Similar to Configuration 1, the converted elastic power X of the cleaning blade 5 satisfies the range of from 57% to 90%.

However, the edge region thickness t is out of the range of from 0.05 mm to 0.20 mm. The cleaning capability was rated as poor. That is, defective cleaning is recognizable. Practically, the outputs images are deemed substandard.

According to the above verification results, the following is known.

In Blade type 3, if the edge region thickness t is smaller than 0.05 mm, the backup region 7 is exposed as the edge 61 is abraded. Then, the cleaning capability is degraded. If the edge region thickness t of Blade type 3 is greater than 0.20 mm, the percentage of the low-hardness region is relatively large. Then, the cleaning blade 5 is liable to fatigue.

By contrast, according to the above verification results, the combination of the features of Embodiment 1 and the feature that the edge region thickness t of Blade type 3 ranges from 0.05 mm to 0.20 mm can suppress the degradation of cleaning capability and fatigue of the cleaning blade 5.

Embodiment 9

The cleaning blade 5 according to Embodiment 9, usable in the above-described cleaning device 1, is described.

In Embodiment 9, the cleaning blade 5 has the features according to Embodiments 1, 2, and 3. Further, in Embodiment 6, Blade type and the range of the edge region thickness t is specified.

Accordingly, redundant descriptions about structures similar to Embodiments 1 through 3 and action and effects thereof are omitted. Unless it is necessary to distinguish, the same reference characters are given to the same or similar elements in the descriptions below.

Specifically, in the present embodiment, the converted elastic power X defined by Formula 1 ranges from 57% to 90%, and, in Blade type 4 illustrated in FIG. 4D, the edge region thickness t ranges from 0.05 mm to 0.50 mm.

Setting the blade type and the edge region thickness t as described above can attain the following effect.

In Blade type 4, if the edge region thickness t is smaller than 0.05 mm, the backup region 7 is exposed as the edge 61 is abraded. Then, the cleaning capability is degraded. If the edge region thickness t of Blade type 4 is greater than 0.50 mm, the percentage of the low-hardness region is relatively large. Then, the cleaning blade 5 is liable to fatigue.

By contrast, when the edge region thickness t of Blade type 4 is in the range of from 0.05 mm to 0.50 mm, degradation of cleaning capability and fatigue are suppressed.

Next, a verification experiment performed to ascertain effects attained by examples of the cleaning blade 5 according to the present embodiment is described.

Evaluation of Cleaning Capability

The cleaning capability was evaluated under the following conditions.

As a test machine (an image forming apparatus), Ricoh MPC 3503 was used. In the test machine, the cleaning blade 5 of the process cartridge 121 illustrated in FIG. 2 was replaced with those according to Configurations 1 through 3 and Comparative examples 1 through 5 specified in Table 9.

The test machine was left unused for 24 hours in the cold environment (with a temperature of 10° C. and a humidity of 15%), and then images were successively output on 30,000 sheets. To input a greater amount of toner to the photoconductor 10, a solid image extending entirely on A4 size was input.

The cleaning capability was rated in four grades of "Excellent", "Good", "Acceptable", and "Poor" in the following manner.

Excellent: No trace of defective cleaning is observed on the recording sheet after feeding of 30,000 sheets. There is no practical disadvantage. Defective cleaning does not occur even under a severe condition in which the charging current is increased, which is a harsh condition for cleaning.

Good: After output of 30,000 sheets, the trace of defective cleaning is not observed on the recording sheets, and practically there are no problems.

Acceptable: No trace of defective cleaning is observed on the recording sheets after output of 30,000 sheets. Although there is no practical disadvantage, toner escaping the cleaning blade 5 on the photoconductor 10 is observed with eyes.

Poor: After output of 30,000 sheets, the trace of defective cleaning is observed on the recording sheets, and the outputs images are practically substandard.

Verification Results

Evaluation results of configurations according to the present embodiment and the comparative examples are presented in Table 9 below.

TABLE 9

| | Blade type | X | $S_A$ [mm$^2$] | $S_B$ [mm$^2$] | $e_A$ | $e_B$ | t [mm] | Cleaning capability |
|---|---|---|---|---|---|---|---|---|
| Configuration 1 | 4 | 90 | 0.1 | 22.4 | 70 | 90 | 0.05 | Excellent |
| Configuration 2 | 4 | 90 | 0.2 | 22.3 | 70 | 90 | 0.10 | Excellent |
| Configuration 3 | 4 | 89 | 1.0 | 21.5 | 70 | 90 | 0.50 | Good |
| CMP example 1 | 4 | 90 | 0.0 | 22.5 | 70 | 90 | 0.01 | Poor |
| CMP example 2 | 4 | 90 | 0.0 | 16.2 | 70 | 90 | 0.01 | Poor |
| CMP example 3 | 4 | 88 | 2.0 | 20.5 | 70 | 90 | 1.00 | Poor |
| CMP example 4 | 4 | 87 | 3.0 | 19.5 | 70 | 90 | 1.50 | Poor |
| CMP example 5 | 4 | 86 | 4.0 | 18.5 | 70 | 90 | 2.00 | Poor |

Configuration 1

The blade type used is Blade type 4 illustrated in FIG. 4D. The edge region 6 including the edge 61 has a cross-sectional area $S_A$ of 0.1 mm$^2$, the backup region 7 has a cross-sectional area $S_B$ of 22.4 mm$^2$, the elastic power $e_A$ of the edge region 6 is 70%, and the elastic power $e_B$ of the backup region 7 is 90%.

The converted elastic power X calculated according to Formula 1 is 90%. As described above, the converted elastic power X is used to evaluate the elasticity of the cleaning blade 5 as a whole.

The converted elastic power X of Configuration 1 satisfies the range specified in Embodiment 1 (from 57% to 90%).

In Configuration 1, the edge region thickness t is 0.05 mm and satisfies the specified range of from 0.05 mm to 0.50 mm. Cleaning capability was rated as excellent. That is, defective cleaning did not occur.

Configurations 2 and 3

Similar to Configuration 1, the converted elastic power X of the cleaning blade 5 satisfies the range of from 57% to 90%.

Similar to Configuration 1, the edge region thickness t satisfies the specified range of from 0.05 mm to 0.50 mm. Cleaning capability was rated as either excellent or good. That is, defective cleaning did not occur.

Comparative Examples 1 Through 5

Similar to Configuration 1, the converted elastic power X of the cleaning blade 5 satisfies the range of from 57% to 90%.

However, the edge region thickness t is out of the range of from 0.05 mm to 0.50 mm. The cleaning capability was rated as poor. That is, defective cleaning is recognizable. Practically, the outputs images are deemed substandard.

According to the above verification, results, the following is known.

In Blade type 4, if the edge region thickness t is smaller than 0.05 mm, the backup region 7 is exposed as the edge 61 is abraded. Then, the cleaning capability is degraded. If the edge region thickness t of Blade type 4 is greater than 0.50 mm, the percentage of the low-hardness region is relatively large. Then, the cleaning blade 5 is liable to fatigue.

By contrast, according to the verification results, the combination of the features of Embodiment 1 and the feature that the edge region thickness t of Blade type 4 ranges from 0.05 mm to 0.50 mm can suppress the degradation of cleaning capability and fatigue of the cleaning blade 5.

Embodiment 10

A cleaning device 1A according to Embodiment 10, which includes the cleaning blade 5 according to any one of Embodiments 1 through 9, is described with reference to FIG. 6.

Figure 6:
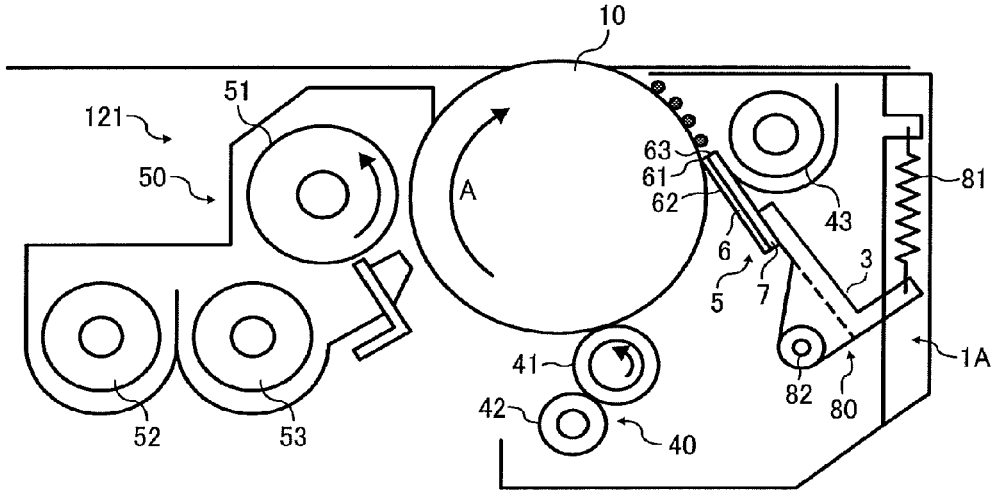
FIG. 6 is a schematic diagram illustrating a process cartridge according to Embodiment 10.

FIG. 6 is a schematic diagram illustrating an example of the process cartridge 121 according to Embodiment 10. Similar to FIG. 2, the cleaning blade 5 illustrated in FIG. 6 is Blade type 2 illustrated in FIG. 4B, of the four types illustrated in FIGS. 4A through 4D.

The cleaning device 1A according to the present embodiment is different from the cleaning device 1 according to any one of Embodiments 1 through 9 regarding the structure to press the cleaning blade 5 to the photoconductor 10.

Accordingly, redundant descriptions about structures similar to Embodiments 1 through 9 and action and effects thereof are omitted. Unless it is necessary to distinguish, the same reference characters are given to the same or similar elements in the descriptions below.

In the cleaning device 1, illustrated in FIG. 2, according to any one of Embodiments 1 through 9, the cleaning blade 5 abutting against the photoconductor 10 (the edge 61 is in contact with the photoconductor 10) is deformed to attain a predetermined pressing force (line pressure), and the cleaning blade 5 is secured in such a deformed state (hereinafter "pressurized-state attachment"). That is, the configuration illustrated in FIG. 2 employs pressurized-state attachment to press the cleaning blade 5 against the photoconductor 10.

By contrast, the cleaning device 1A according to Embodiment 10 employs spring pressurizing to press the cleaning blade 5 against the photoconductor 10. Specifically, in spring pressurizing used the cleaning device 1A, as illustrated in FIG. 6, the blade holder 3 to support the cleaning blade 5 is rotatable (or pivotable), and a pressing device 80 including a spring 81 biases the blade holder 3 toward the photoconductor 10, thereby pressing the edge 61 against the photoconductor 10. In other words, spring pressurizing is used to secure the blade holder 3, which supports the cleaning blade 5.

In the configuration illustrated in FIG. 6, with tension exerted by the spring 81, the pressing device 80 applies pressure to the edge 61 of the cleaning blade 5 abutting against the photoconductor 10. In this structure, a rotation support 82 of the blade holder 3 serves as a fulcrum. The spring pressurizing is of constant contact-pressure type and keeps a contact pressure of the cleaning blade 5 with the photoconductor 10 constant regardless with elapse of time. In the present embodiment, the pressing force of the edge 61 of the cleaning blade 5 is set at 20.0 g/cm.

The following effect is available when the cleaning device 1A employing spring pressurizing includes the cleaning blade 5 according to any one of Embodiments 1 through 9.

In a configuration in which a cleaning blade is pressed against an object to be cleaned in pressurized-state attachment, when the cleaning blade fatigues, the cleaning capability is liable to deteriorate due to decreases in line pressure.

By contrast, in configurations employing spring pressurizing such as the cleaning device 1A, even when the cleaning blade 5 fatigues, decreases in line pressure are suppressed, thereby securing the cleaning capability.

Next, a verification experiment performed to ascertain effects attained by the cleaning device 1A employing spring pressurizing, according to the present embodiment, is described.

Evaluation of Cleaning Capability

The cleaning capability was evaluated under the following conditions.

As a test machine (an image forming apparatus), Ricoh MPC 3503 was used. In the test machine, the cleaning blade 5 of the process cartridge 121 illustrated in FIG. 6 was replaced with those according to Configurations 1 through 5 and Comparative examples 1 through 5 specified in Table 10.

The test machine was left unused for 24 hours in the cold environment (with a temperature of 10° C. and a humidity of 15%), and then images were successively output on 30,000 sheets. To input a greater amount of toner to the photoconductor 10, a solid image extending entirely on A4 size was input. As described above, the pressing force of the edge 61 of the cleaning blade 5 is set at 20.0 g/cm.

The cleaning capability was rated in four grades of "Excellent", "Good", "Acceptable", and "Poor" in the following manner.

Excellent: After output of 30,000 sheets, the trace of defective cleaning is not observed on the recording sheets, and practically there are no problems. Defective cleaning does not occur even under a severe condition in which the charging current is increased, which is a harsh condition for cleaning.

Good: After output of 30,000 sheets, the trace of defective cleaning is not observed on the recording sheets, and practically there are no problems.

Acceptable: No trace of defective cleaning is observed on the recording sheets after output of 30,000 sheets. Although there is no practical disadvantage, toner escaping the cleaning blade 5 on the photoconductor 10 is observed with eyes.

Poor: After output of 30,000 sheets, the trace of defective cleaning is observed on the recording sheets, and the outputs images are practically substandard.

Verification Results

Evaluation results of configurations according to the present embodiment and the comparative examples are presented in Table 10 below.

TABLE 10

| | Blade type | X | $S_A$ [mm$^2$] | $S_B$ [mm$^2$] | $e_A$ | $e_B$ | t [mm] | Pressing Type | Cleaning capability |
|---|---|---|---|---|---|---|---|---|---|
| Configuration 1 | 1 | 57 | 5.8 | 16.8 | 50 | 60 | 0.20 | Spring | Good |
| Configuration 2 | 2 | 57 | 5.6 | 16.3 | 50 | 60 | 0.45 | Spring | Good |
| Configuration 3 | 2 | 57 | 6.3 | 16.3 | 50 | 60 | 0.50 | Spring | Good |
| Configuration 4 | 3 | 60 | 0.2 | 22.3 | 50 | 60 | 0.10 | Spring | Good |
| Configuration 5 | 4 | 60 | 0.2 | 22.3 | 50 | 60 | 0.10 | Spring | Good |
| CMP example 1 | 1 | 57 | 5.8 | 16.8 | 50 | 60 | 0.20 | Attached | Poor |
| CMP example 2 | 2 | 57 | 5.6 | 16.3 | 50 | 60 | 0.45 | Attached | Poor |
| CMP example 3 | 2 | 57 | 6.3 | 16.3 | 50 | 60 | 0.50 | Attached | Poor |
| CMP example 4 | 3 | 60 | 0.2 | 22.3 | 50 | 60 | 0.10 | Attached | Poor |
| CMP example 5 | 4 | 60 | 0.2 | 22.3 | 50 | 60 | 0.10 | Attached | Poor |

Configuration 1

The blade type used is Blade type 1 illustrated in FIG. 4A. The edge region 6 including the edge 61 has a cross-sectional area $S_A$ of 5.8 mm$^2$, the backup region 7 has a cross-sectional area $S_B$ of 16.8 mm$^2$, the elastic power $e_A$ of the edge region 6 is 50%, and the elastic power $e_B$ of the backup region 7 is 60%.

The converted elastic power X calculated according to Formula 1 is 57%. As described above, the converted elastic power X is used to evaluate the elasticity of the cleaning blade 5 as a whole.

The converted elastic power X of Configuration 1 satisfies the range specified in Embodiment 1 (from 57% to 90%).

Spring pressurizing is used to press the cleaning blade 5 against the photoconductor 10. Cleaning capability was rated as good. That is, defective cleaning did not occur.

Configurations 2 Through 5

Similar to Configuration 1, the converted elastic power X of the cleaning blade 5 satisfies the range of from 57% to 90%.

Similar to Configuration 1, spring pressurizing is used to press the cleaning blade 5 against the photoconductor 10. Cleaning capability was rated as good, and defective cleaning did not occur.

Comparative Examples 1 Through 5

Similar to Configuration 1, the converted elastic power X of the cleaning blade 5 satisfies the range of from 57% to 90%.

However, the cleaning blade 5 is pressed against the photoconductor 10 in pressurized-state attachment. Cleaning capability was rated as poor. That is, defective cleaning is recognizable. Practically, the outputs images are deemed substandard.

According to the above verification results, the following is known.

In configurations in which the cleaning blade 5 is pressed against the photoconductor 10 in pressurized-state attachment, when the cleaning blade 5 fatigues, the cleaning capability is liable to deteriorate due to decreases in line pressure.

By contrast, in configurations employing the feature of Embodiment 1 and spring pressurizing to press the cleaning blade 5 against the photoconductor 10, even when the cleaning blade 5 fatigues, decreases in line pressure are suppressed, thereby securing the cleaning capability.

Although Embodiments 1 through 10 are described above with reference to the drawings, numerous additional modifications and variations are possible in light of the above teachings. The disclosure of this patent specification may be practiced otherwise than the cleaning blade, the cleaning devices, and the image forming apparatus described above.

Next, descriptions are given below of the photoconductor 10 (an image bearer) usable in the above-described image forming apparatus 100, with reference to drawings.

FIGS. 7A through 7D illustrate layer structures applicable to the photoconductor 10 according to the embodiments. In the layer structure illustrated in FIG. 7A, the photoconductor 10 includes a conductive support 91 and a photosensitive layer 92 overlying the conductive support 91, and inorganic particles are present at or adjacent to the surface of the photosensitive layer 92. The layer structure illustrated in FIG. 7B includes, from the bottom, the conductive support 91, the photosensitive layer 92, and a surface layer 93 including inorganic particles. The layer structure illustrated in FIG. 7C includes, from the bottom, the conductive support 91, the photosensitive layer 92, and the surface layer 93 including inorganic particles. Further, the photosensitive layer 92 includes a charge generation layer 921 and a charge transport layer 922. The layer structure illustrated in FIG. 7D includes, from the bottom, the conductive support 91; a under layer 94; the photosensitive layer 92 including the charge generation layer 921 and the charge transport layer 922; and the surface layer 93 including inorganic particles.

That is, the photoconductor 10 according to the present embodiment includes at least the photosensitive layer 92 above the conductive support 91, and another layer (e.g., the surface layer 93) or other layers can be combined in such as layer structure.

Figure 7A:
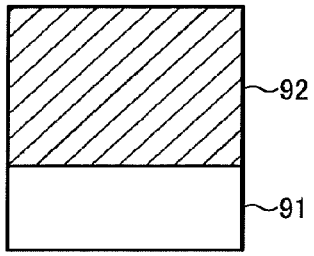
FIGS. 7A through 7D illustrate layer structures of a photoconductor usable in Embodiments 1 through 10.

For example, in the layer structure illustrated in FIG. 7A, the photosensitive layer 92 serves as the surface layer, and the photosensitive layer 92 includes inorganic particles. When the photosensitive layer 92 includes the charge generation layer 921 and the charge transport layer 922 superimposed thereon as the surface layer, the charge transport layer 922 includes inorganic particles.

Examples of inorganic particles added to the layer structure include metal powder such as copper, tin, aluminum, and indium; metal oxide such as silicon oxide, silica, tin oxide, zinc oxide, titanium oxide, indium oxide, antimony oxide, bismuth oxide, tin oxide in which antimony is doped, and indium oxide in which tin is doped; and inorganic material such as potassium titanate. Metal oxide is particularly preferable, and further silicon oxide, aluminum oxide, and titanium oxide are effective.

The inorganic particle preferably has an average primary particle diameter ranging from 0.01 to 0.5 μm, considering the characteristics of the surface layer 93 such as light transmission degree and abrasion resistance. The abrasion resistance and the degree of dispersion decrease when the average primary particle diameter is smaller than 0.01 μm. Additionally, when the average primary particle diameter is greater than 0.5 μm, inorganic particles in the dispersion liquid can sink more easily, and toner filming can occur.

As the amount of inorganic particles added increases, abrasion resistance increases, which is desirable. However, if the amount of inorganic particles is extremely large, residual potentials may rise, and the degree at which writing light transmits a protective layer may decrease, resulting in side effects. Generally, the amount of addition to the total solid amount is preferably 30% by weight or smaller, and more preferably 20% by weight or smaller. The lower limit is generally 3% by weight.

The above-described inorganic particles can be treated with at least one surface treatment agent, which is preferable for facilitating the dispersion of inorganic particles.

Decreases in dispersion of inorganic particles can cause, in addition to the rise of residual potentials, degradation of transparency of coating, defective coating, and further degradation of abrasion resistivity. Accordingly, the decrease in dispersion of inorganic particles can hinder the extension of operational life or image quality improvement.

Figure 7B:
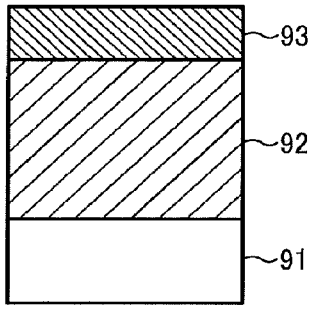
Figure 7C:
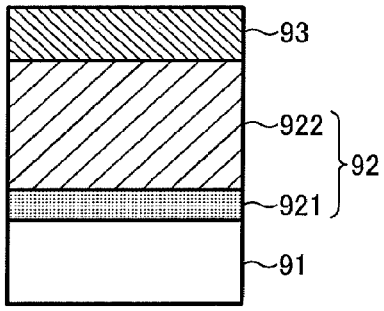
Figure 7D:
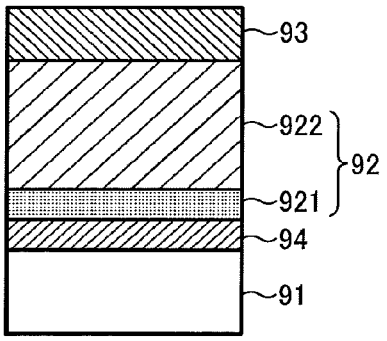

Next, descriptions are given below of the photoconductor 10 in which the surface layer 93 including inorganic particle is disposed above the photosensitive layer 92, as illustrated in FIGS. 7B through 7D.

The surface layer 93 includes at least inorganic particles and binder resin. Examples of inorganic particles include metal powder such as copper, tin, aluminum, and indium; metal oxide such as silicon oxide, silica, tin oxide, zinc oxide, titanium oxide, indium oxide, antimony oxide, bismuth oxide, tin oxide in which antimony is doped, and indium oxide in which tin is doped; and inorganic material such as potassium titanate. Metal oxide is particularly preferable, and further silicon oxide, aluminum oxide, and titanium oxide are effective.

The inorganic particle preferably has an average primary particle diameter ranging from 0.01 μm to 0.5 μm, considering the characteristics of the surface layer 93 such as light transmission degree and abrasion resistance.

The abrasion resistance and the degree of dispersion decrease when the average primary particle diameter is smaller than or equal to 0.01 μm. Additionally, when the average primary particle diameter is greater than or equal to 0.5 μm, inorganic particles in the dispersion liquid can sink more easily, and toner filming can occur.

When the concentration (percentage) of inorganic particles added to the surface layer 93 is large, abrasion resistivity is high, which is desirable. An extremely large amount of inorganic particles, however, causes increases in residual potentials and decreases in the degree at which writing light transmits the protective layer, and side effects may arise.

Generally, the amount of addition to the total solid amount is preferably 50% by weight or smaller, and more preferably 30% by weight or smaller. The lower limit is generally about 5% by weight.

The above-described inorganic particles can be treated with at least one surface treatment agent, which is preferable for facilitating the dispersion of inorganic particles.

Decreases in dispersion of inorganic particles can cause, in addition to the rise of residual potentials, degradation of transparency of coating, defective coating, and further degradation of abrasion resistivity. Accordingly, the decrease in dispersion of inorganic particles can hinder the extension of operational life or image quality improvement.

Typical surface treatment agents can be used, but surface treatment agents capable of maintaining insulation of inorganic particles are preferable.

For example, titanate coupling agents, aluminum coupling agents, zircoaluminate coupling agents, higher fatty acids, mixtures of silane coupling agents and those, $Al_2O_3$, $TiO_2$, $ZrO_2$, silicone, aluminum stearate, and mixtures of two or greater of them are preferable as the surface treatment agent to attain preferable dispersion of inorganic particles and inhibition of image blurring.

Although treatment with silane coupling agents increases image blurring effects, the effects may be inhibited by mixing the above-described surface treatment agents in the silane coupling agent.

The amount of surface treatment agent is preferably from 3% by weight to 30% by weight, and, more preferably, from 5% by weight to 20% by weight although the amount of surface treatment agent depends on the average primary particle diameter of inorganic particle. If the amount of surface treatment is smaller than this range, dispersion of inorganic particles is insufficient, and, if the amount is extremely large, the residual potential can rise significantly. The above-mentioned inorganic particles can be used alone or in combination.

The above-mentioned inorganic particles can be dispersed using a dispersing device. The average particle diameter of the inorganic particles in the dispersion liquid is preferably smaller than or equal to 1 μm and, more preferably, smaller than or equal to 0.5 μm considering the transmittance of the surface layer 93.

Next, descriptions are given below of toner suitable for image forming apparatuses employing the blades having at least one of features described in this specification.

Figure 8A:
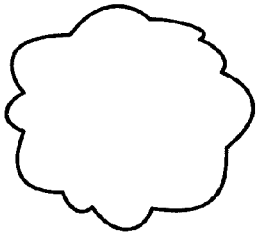
FIGS. 8A and 8B are illustrations of measurement of circularity of toner.

FIGS. 8A and 10B are illustrations of measurement of circularity of toner.

To improve image quality, in image forming apparatuses employing the blades according to the embodiments, it is preferable to use polymerization toner produced by suspension polymerization, emulsion polymerization, or dispersion polymerization, which is suitable for enhancing circularity and reducing particle diameter. Particularly preferable is use of polymerization toner having a circularity greater than or equal to 0.97 and a volume average particle diameter smaller than or equal to 5.5 μm. High resolution can be attained by use of polymerization toner having a circularity greater than or equal to 0.97 and a volume average particle diameter smaller than or equal to 5.5 μm.

Figure 8B:
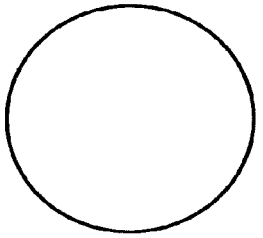

The circularity used herein is an average circularity measured by a flow-type particle image analyzer FPIA-2000 of SYSMEX CORPORATION. The average circularity is measured as follows. As a dispersant, put 0.1 ml to 0.5 ml of surfactant, preferably alkylbenzene sulfonate, in 100 ml to 150 ml of water from which impure solid materials are previously removed, and add 0.1 g to 0.5 g of the sample (toner) to the mixture. Then, disperse the mixture including the toner with an ultrasonic disperser for 1 to 3 minutes to prepare a dispersion liquid having a concentration of from 3,000 to 10,000 pieces/μl, and measure the toner shape and distribution with the above-mentioned measurer. Based on the measurement results, obtain C2/C1 where C1 represents the peripheral length of the projected toner particle having an area S illustrated in FIG. 8A, and C2 represents the peripheral length of the perfect circle illustrated in FIG. 8B, having the area S similar to the projected toner particle illustrated in FIG. 8A. The average of C2/C1 is used as the circularity.

The volume average particle diameter of toner can be measured by a coulter counter method.

Specifically, number distribution and volume distribution of toner, measured by Coulter Multisizer 2e from Beckman Coulter, are output, via an interface from Nikkaki Bios Co., Ltd., to a computer and analyzed. More specifically, as an electrolyte, a NaCl aqueous solution including a primary sodium chloride of 1% is prepared.

Initially, 0.1 ml to 5 ml of surfactant, preferably alkylbenzene sulfonate, is added as dispersant to 100 ml to 150 ml of electrolyte.

Add, as test sample, 2 mg to 20 mg of toner to the mixture and disperse the test sample by an ultrasonic disperser for 1 to 3 minutes. Put 100 ml to 200 ml of the electrolyte solution in a separate beaker, and put the above-described sample therein to attain a predetermined concentration. Then, using Coulter Multisizer 2e, measure the particle diameter of 50,000 toner particles with an aperture of 100 μm.

The number of channels used in the measurement is thirteen. The ranges of the channels are from 2.00 μm to less than 2.52 μm, from 2.52 μm to less than 3.17 μm, from 3.17 μm to less than 4.00 μm, from 4.00 μm to less than 5.04 μm, from 5.04 μm to less than 6.35 μm, from 6.35 μm to less than 8.00 μm, from 8.00 μm to less than 10.08 μm, from 10.08 μm to less than 12.70 μm, from 12.70 μm to less than 16.00 μm, from 16.00 μm to less than 20.20 μm, from 20.20 μm to less than 25.40 μm, from 25.40 μm to less than 32.00 μm, from 32.00 μm to less than 40.30 μm. The range to be measured is set from 2.00 μm to less than 40.30 μm. The targets are toner particles having a particle diameter in a range of from 2.00 μm to 32.0 μm. Calculate the volume average particle diameter represented as $\Sigma XfV/\Sigma fV$, where X represents a representative diameter in each channel, V represents an equivalent volume of the representative diameter in each channel, and f represents the number of particles in each channel.

The various aspects of the present specification can attain specific effects as follows.

Aspect A

An elastic blade (e.g., the cleaning blade 5) includes a contact edge (e.g., the edge 61) to contact a contact object (e.g., the photoconductor 10). On a cross section perpendicular to the direction in which the contact edge extends, the blade includes an edge region including the contact edge and a backup region different in at least one of a material and a physical property from the edge region. The backup region is free of direct contact with the contact object.

Additionally, a converted elastic power X defined by Formula 1 is in a range of from 57% to 90%, $$X = \frac{S_A}{S_A + S_B} \times e_A + \frac{S_B}{S_A + S_B} \times e_B \quad \text{Formula 1}$$

$S_A$ represents a cross-sectional area in millimeters of the edge region on the cross section perpendicular to the edge extending direction, $S_B$ represents a cross-sectional area in millimeters of the backup region 7 on the cross section perpendicular to the edge extending direction, $e_A$ represents an elastic power (%) of the edge region, $e_B$ represents an elastic power (%) of the backup region, and t represents an edge region thickness in millimeters.

On the cross section perpendicular to the edge extending, the edge region has a long side and a short side both opposing the contact object (e.g., the photoconductor 10), and the edge region thickness t represents a length in a direction perpendicular to the long side of the edge region.

According to this aspect, as described in the embodiments, when the converted elastic power X, which is used to evaluate the elasticity of the entire blade, is in the range of from 57% to 90%, the degradation of the follow-up capability and the fatigue of the blade are suppressed. Such inconveniences may occur when the elasticity of the blade as a whole is relatively low, Simultaneously, the risk of vibration of the blade and chipping of the contact edge due to stick-slip, which occur when the blade has a relatively high elasticity, are suppressed.

Aspect B

In Aspect A, the Martens hardness $h_A$ of the edge region including the contact edge is greater than or equal to 1.5 $N/mm^2$.

With this aspect, as described in the embodiments, the toner external additives are inhibited from adhering to the surface of the contact object (e.g., the photoconductor 10), thereby inhibiting inconveniences such as filming.

Aspect C

In Aspect A, the Martens hardness $h_A$ of the edge region is greater than the Martens hardness $h_B$ of the backup region.

With this aspect, as described in the embodiments, the inconveniences such as toner escaping and chipping of the contact edge are inhibited.

Aspect D

In Aspect A, the elastic power $e_A$ of the edge region is greater than or equal to 50%.

With this aspect, as described in the embodiments, abrasion and chipping of the contact edge can be inhibited, thereby inhibiting defective cleaning.

Aspect E

In Aspect A, the elastic power $e_B$ of the backup region is greater than or equal to 60%.

With this aspect, as described in the embodiments, toner escaping caused by an insufficient contact pressure can be inhibited.

Aspect F

In any one of Aspects A through C, a blade holder is attached to the blade to support the blade, and the edge region extends along the circumference of the blade except the portion adjoining the blade holder, on the cross section perpendicular to the edge extending direction in which the contact edge extends (Blade type 1 illustrated in FIG. 3A). In a corner portion around the contact edge, the boundary between the edge region and the backup region is arc-shaped such that the corner of the backup region is chamfered. In Blade type 1, the edge region thickness t represents a length in the direction perpendicular to the long side. For example, the edge region thickness t is a thickness of a portion of the edge region extending along a long side (e.g., the opposing face 62 to oppose the contact object). Additionally, the edge region thickness t is in a range of from 0.05 mm to 0.20 mm.

With this aspect, as described in the embodiments, degradation of cleaning capability and fatigue are suppressed.

Aspect G

In any one of Aspects A through C, on the cross section perpendicular to the direction in which the contact edge extends, the blade is divided into the edge region and the backup region with a boundary parallel to a long side (e.g., the opposing face 62) of the blade. The edge region thickness tin Blade type 2 is in a range of from 0.05 to 0.50 mm.

With this aspect, as described in the embodiments, degradation of cleaning capability and fatigue are suppressed.

Aspect H

In any one of Aspects A through C, on the cross section perpendicular to the edge extending direction, a boundary between the edge region and the backup region is symmetrical relative to a reference line ($L_s$) penetrating a center of a short side (e.g., the end face 63) of the blade and parallel to a long side of the blade. The short side includes the contact edge. The boundary is curved in end portions (around the corners of the blade) away from the reference line such that the thickness of the edge region in the direction parallel to the long side increases toward the corner. In a portion closer to the reference line than the end portions, the edge region is almost linear and the thickness in the direction parallel to the long side is constant or almost constant. In Blade type 3, the edge region thickness t is the thickness of the linear portion of the edge and is in a range of from 0.05 mm to 0.20 mm.

With this aspect, as described in the embodiments, degradation of cleaning capability and fatigue are suppressed.

Aspect

In any one of Aspects A through C, a boundary between the edge region and the backup region is a segment that linearly connects points (62P and 63P) on two sides of the blade both starting from the edge 61 so that the edge region is shaped in a triangle. The edge region thickness tin Blade type 4 is in a range of from 0.05 mm to 0.50 mm.

With this aspect, as described in the embodiments, degradation of cleaning capability and fatigue are suppressed.

Aspect J

An image forming apparatus includes an image bearer (e.g., the photoconductor 10) and the blade according to any one of Aspects A through I, and the contact edge of the blade is disposed in contact with a surface of the image bearer.

With this aspect, as described in the embodiments, in the image forming apparatus, the occurrence of image failure caused by defective cleaning is suppressed.

The above-described embodiments are illustrative and do not limit the present invention. Thus, numerous additional modifications and variations are possible in light of the above teachings. For example, elements and/or features of different illustrative embodiments may be combined with each other and/or substituted for each other within the scope of the present invention.

What is claimed is:

1. An elastic blade comprising:

a contact edge to contact a contact object;

an edge region including the contact edge; and a backup region different in at least one of a material and a physical property from the edge region, the backup region adjacent to the edge region on a cross section perpendicular to a direction in which the contact edge extends, the cross section including both the edge region and the backup region, the backup region free of direct contact with the contact object, wherein a converted elastic power X is in a range of from 57% to 90%, the converted elastic power X defined as:

$$X = \frac{S_A}{S_A + S_B} \times e_A + \frac{S_B}{S_A + S_B} \times e_B,$$

where $S_A$ represents a cross-sectional area in millimeters of the edge region on the cross section, $S_B$ represents a cross-sectional area in millimeters of the backup region on the cross section, $e_A$ represents an elastic power of the edge region, and $e_B$ represents an elastic power of the backup region, wherein, on the cross section, the edge region has a long side to oppose the contact object, and a short side to oppose the contact object, and wherein an edge region thickness represents a thickness of the edge region in a direction perpendicular to the long side of the edge region.

2. The elastic blade according to claim 1, wherein the edge region has a Martens hardness greater than or equal to 1.5 N/mm$^2$.

3. The elastic blade according to claim 1, wherein a Martens hardness of the edge region is greater than a Martens hardness of the backup region.

4. The elastic blade according to claim 1, wherein the elastic power of the edge region is greater than or equal to 50%.

5. The elastic blade according to claim 1, wherein the elastic power of the backup region is greater than or equal to 60%.

6. The elastic blade according to claim 1, wherein a blade holder is attached to the elastic blade, wherein, on the cross section, the edge region extends along a circumference of the elastic blade except a portion adjoining the blade holder, wherein a boundary between the edge region and the backup region is arc-shaped in a corner portion around the contact edge such that a corner of the backup region is chamfered, and wherein the edge region thickness is in a range of from 0.05 mm to 0.20 mm.

7. The elastic blade according to claim 1, wherein, on the cross section, the edge region is divided from the backup region with a boundary parallel to a long side of the elastic blade, and wherein the edge region thickness is in a range of from 0.05 mm to 0.50 mm.

8. The elastic blade according to claim 1, wherein, on the cross section, the edge region is divided from the backup region with a boundary symmetrical relative to a reference line penetrating a center of a short side of the elastic blade including the contact edge, the reference line parallel to a long side of the elastic blade, wherein the edge region includes:

curved portions respectively positioned around corners of the elastic blade away from the reference line, the curved portions in each of which a thickness in a direction parallel to the long side increases toward one of the corners; and a linear portion closer to the reference line than the curved portions, the linear portion having a substantially constant thickness in the direction parallel to the long side, and wherein the thickness of the linear portion serves as the edge region thickness and is in a range of from 0.05 mm to 0.20 mm.

9. The elastic blade according to claim 1, wherein a shape of the edge region on the cross section is a triangle, and wherein the edge region thickness is in a range of from 0.05 mm to 0.50 mm.

10. An image forming apparatus comprising:

an image bearer; and the elastic blade according to claim 1, wherein the contact edge of the elastic blade is disposed in contact with a surface of the image bearer to clean the image bearer.

11. A cleaning device comprising:

the elastic blade according to claim 1;

a blade holder to support the elastic blade; and a pressing device to press, via the blade holder, the contact edge of the elastic blade against the contact object.

* * * * *